US009397393B2

(12) United States Patent
Ali et al.

(10) Patent No.: US 9,397,393 B2
(45) Date of Patent: Jul. 19, 2016

(54) METHOD AND SYSTEM FOR MULTIPLE FEED POINT ANTENNAS

(71) Applicant: BlackBerry Limited, Waterloo (CA)

(72) Inventors: Shirook M. Ali, Milton (CA); Abdulhadi Ebrahim Abdulahdi, Montreal (CA); Christopher Andrew Devries, St. Thomas (CA)

(73) Assignee: BlackBerry Limited, Waterloo, CA (US)

( * ) Notice: Subject to any disclaimer, the term of this patent is extended or adjusted under 35 U.S.C. 154(b) by 247 days.

(21) Appl. No.: 13/947,718

(22) Filed: Jul. 22, 2013

(65) Prior Publication Data

US 2015/0022411 A1 Jan. 22, 2015

(51) Int. Cl.

| | |
|---|---|
| ***H01Q 1/50*** | (2006.01) |
| ***H01Q 7/00*** | (2006.01) |
| ***H01Q 9/16*** | (2006.01) |
| ***H01Q 19/10*** | (2006.01) |
| ***H01Q 1/24*** | (2006.01) |

(52) U.S. Cl.

CPC ..... *H01Q 1/50* (2013.01); *H01Q 1/246* (2013.01); *H01Q 7/00* (2013.01); *H01Q 9/16* (2013.01); *H01Q 19/10* (2013.01); *Y10T 29/49016* (2015.01)

(58) Field of Classification Search

CPC ..... H01Q 1/50; H01Q 19/10; H01Q 7/00; H01Q 9/16

USPC ..... 343/793, 834, 866, 904; 29/600

See application file for complete search history.

(56) References Cited

U.S. PATENT DOCUMENTS

| | | | | |
|---|---|---|---|---|
| 5,872,543 | A | 2/1999 | Smith et al. | |
| 7,692,597 | B2 | 4/2010 | Webb | |
| 8,514,136 | B2 * | 8/2013 | McCarthy et al. | 343/705 |
| 8,717,175 | B2 * | 5/2014 | Fein | 340/572.7 |
| 2003/0193439 | A1 | 10/2003 | Park | |
| 2006/0145923 | A1 * | 7/2006 | Autti | 343/700 MS |
| 2007/0097009 | A1 * | 5/2007 | Torres | 343/795 |
| 2007/0194999 | A1 | 8/2007 | Morton et al. | |
| 2009/0195474 | A1 | 8/2009 | Chien et al. | |
| 2010/0308651 | A1 | 12/2010 | Rofougaran et al. | |

(Continued)

FOREIGN PATENT DOCUMENTS

JP 2013058987 3/2013

OTHER PUBLICATIONS

Wang, L; Guo, Y.-X.; Sheng, W.-X., "Wideband High-Gain 60-GHz LTCC L-Probe Patch Antenna Array With a Soft Surface," Antennas and Propagation, IEEE Transactions on, vol. 61, No. 4, pp. 1802,1809, Apr. 2013.

(Continued)

*Primary Examiner* — Huedung Mancuso
(74) *Attorney, Agent, or Firm* — Moffat & Co.

(57) ABSTRACT

An antenna, including a radiating element configured to have a fundamental resonance frequency being regarded as a first harmonic resonance frequency $f_o$, and feed points positioned on the configured radiating element at selected multiple locations that correspond to where a multiple of the first harmonic resonance frequency have current maxima, wherein feeds at the feed points cooperate at an operating frequency of the antenna to constructively combine their respective antenna radiation patterns.

20 Claims, 20 Drawing Sheets

(56) References Cited

U.S. PATENT DOCUMENTS

| | | | | |
|---|---|---|---|---|
| 2012/0200461 | A1* | 8/2012 | Lee | 343/700 MS |
| 2013/0120218 | A1 | 5/2013 | Kuo et al. | |

OTHER PUBLICATIONS

Yang Gao; Zhenghe Feng; Li Zhang, "High-gain silicon based on-chip dielectric resonator antenna at 60GHz," Microwave and Millimeter Wave Technology (ICMMT), 2012 International Conference on , vol. 1, No., pp. 1,4, May 5-8, 2012.

John Belrose and Peter Bouliane, "The Off-Center-Fed Dipole Revisited: A Broadband, Multiband Antenna," 1990.

Dipole: http://www.amateur-radio-wiki.net/index.php?title=Dipole. Last modified Jan. 19, 2011.

Progress In Electromagnetics Research Symposium Proceedings, KL, Malaysia, Mar. 27-30, 2012. Nguyen Khac Kiem, Dang Nhu Dinh, Hoang The Viet, and Dao Ngoc Chien, "A Novel Design of Dual-feed Single-element Antenna for 4G MIMO Terminals."

Frank M. Caimi and Mark Mongomery, "Dual Feed, Single Element Antenna for WiMAXMIMO Application," Apr. 10, 2008.

http://www.w8ji.com/windom_off_center_fed.htm. Last revised Nov. 1, 2010.

Study of the Off Centre Fed Dipole Antenna—G8ODE, Jan. 2012.

Jim Abercrombie, "Understanding Antennas for the Non-Technical Ham," Jul. 2005.

European Patent Office, Extended European Search Report, Oct. 16, 2014.

* cited by examiner

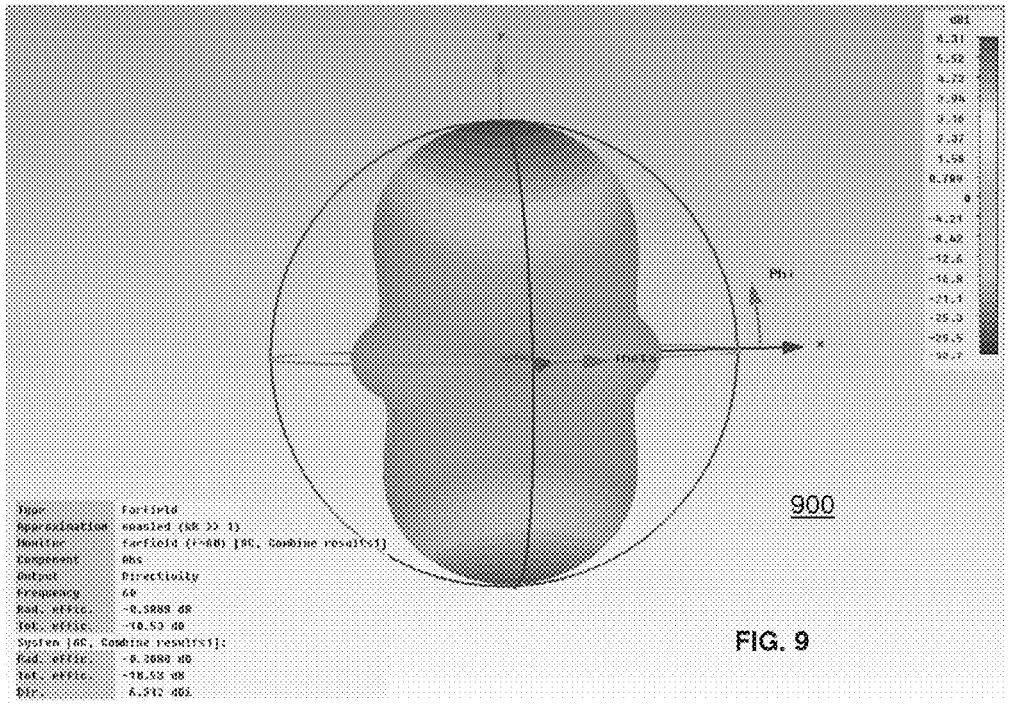
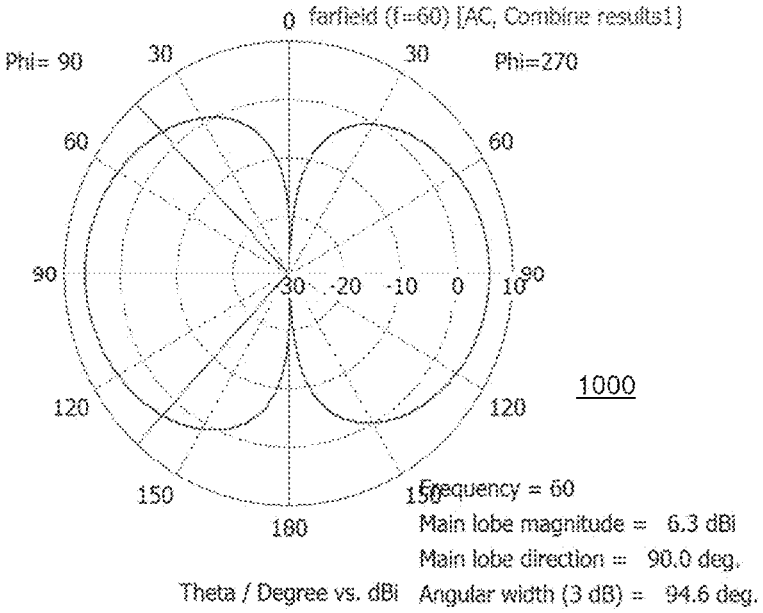
FIG. 10

METHOD AND SYSTEM FOR MULTIPLE FEED POINT ANTENNAS

FIELD OF THE DISCLOSURE

The present disclosure relates to antennas more particularly to a multiple feed line antenna having improved gain and bandwidth.

BACKGROUND

Antennas for mobile wireless communications is dictated by a number of factors, but mainly the volume available for the antenna, the frequency (directly related to this volume) of operation and unique environmental constraints of the wireless communication path (also related to frequency of operation), such as the distance over which wireless communication is to be performed, path loss and such like.

Antennas focus radiated RF energy in it radiation pattern such that there appears to be more power coming from the antenna in a particular direction. The electrical characteristics of an antenna, such as gain, radiation pattern, impedance, bandwidth, resonant frequency and polarization, are the same whether the antenna is transmitting or receiving.

The term antenna gain describes how much power is transmitted in the direction of peak radiation to that of an isotropic source. Gain is a key performance figure which combines the antenna's directivity and electrical efficiency. Antenna gain is usually defined as the ratio of the power produced by the antenna from a far-field source on the antenna's beam axis to the power produced by a hypothetical lossless isotropic antenna, which is equally sensitive to signals from all directions. Usually this ratio is expressed in decibels, and these units are referred to as "decibels-isotropic" (dBi). An alternate definition compares the antenna to the power received by a lossless half-wave dipole antenna, in which case the units are written as dBd.

Antenna gain is sometimes referred to as a function of angle, but when a single number is quoted the gain is the 'peak gain' over all directions.

Directivity measures how much more intensely the antenna radiates in its preferred direction than a mythical "isotropic radiator" when fed with the same total power. It follows then that the higher the gain of an antenna the smaller the effective angle of use. This directly impacts the choice of the antenna for a specific function. To achieve a directivity which is significantly greater than unity, the antenna size needs to be much larger than the wavelength. This can usually achieved using a phased array of half-wave or full-wave antennas. Since a phased array is comprised of a number of individual physically separate antennas, a phased array is not an adequate solution for particular mobile wireless communications due to the size of the aggregated individual antennas plus the gap distance between them.

An antenna radiation pattern is a graphical representation of the intensity of the radiation versus the angle from a perpendicular to a plane of the antenna. The graph is usually circular, the intensity indicated by the distance from the centre based in the corresponding angle. The radiation pattern may be used to determine the beamwidth which is generally accepted as the angle between the two points (on the same plane) at which the radiation falls to "half power" i.e. 3 dB below the point of maximum radiation.

Antenna impedance relates the voltage to the current at the input to the antenna. The real part of the antenna impedance represents power that is either radiated away or absorbed within the antenna. The imaginary part of the impedance represents power that is stored in the near field of the antenna. This is non-radiated power. An antenna with only a real part input impedance (zero imaginary part) is said to be resonant. Note that the impedance of an antenna will vary with frequency. A common measure of how well matched the antenna is to the feed line (transmission line) or receiver is known as the Voltage Standing Wave Ratio (VSWR). VSWR is a real number that is always greater than or equal to 1. A VSWR of 1 indicates no mismatch loss (the antenna is perfectly matched to the transmission line). Higher values of VSWR indicate more mismatch loss.

Although a resonant antenna has by definition an almost purely resistive feed-point impedance at a particular frequency, many (if not most) applications require using an antenna over a range of frequencies. An antenna's bandwidth specifies the range of frequencies over which its performance does not suffer due to a poor impedance match. Bandwidth is typically quoted in terms of VSWR. For instance, an antenna may be described as operating at 100-400 MHz with a VSWR<1.5. This statement implies that the reflection coefficient is less than 0.2 across the quoted frequency range. Hence, of the power delivered to the antenna, only 4% of the power is reflected back to the transmitter. Alternatively, a return loss $S11=20*\log 10(0.2)=-13.98$ dB. Note that the above does not imply that 96% of the power delivered to the antenna is transmitted in the form of electromagnetic radiation; losses must still be taken into account.

Antenna conductors have the lowest feed-point impedance at the resonant frequency where they are just under ¼ wavelength long. The reason a dipole antenna is used at the resonant frequency is not that the ability of a resonant antenna to transmit (or receive) fails at frequencies far from the resonant frequency but has to do with the impedance match between the antenna and the transmitter or receiver (and its transmission line).

As mentioned earlier, higher the gain of an antenna the smaller the effective angle of use. This directly impacts the choice of the antenna for a specific function. In mobile cellular applications the factors discussed above play an important consideration in trying to realize a small form factor efficient antenna.

In recent years, there is increasing interest in the worldwide unlicensed band at 60 GHz for wireless data communication services. The frequency bands for the operation of these millimeter wavelength radio frequencies are different for various regions in the world. In 2001, the United States Federal Communications Commission (FCC) released 7 GHz of bandwidth (57-64) GHz for unlicensed use, while other governments have similarly allowed portions of the 60 GHz band to be used without a license. The use of this frequency band offers interesting features such as high available bandwidth and high capacity for mobile data communication services. However, the main disadvantages of the unlicensed band at 60 GHz are the high path losses (30 dB higher than 2 GHZ) and the oxygen absorption (around 10-15 dB/km). Patches and dielectric resonator antennas may be used to provide high gain at 60 GHz however these have a disadvantage of having to tradeoff one or more characteristics such as gain, directivity and bandwidth.

BRIEF DESCRIPTION OF THE DRAWINGS

The present disclosure will be better understood with reference to the drawings in which:

FIG. 9 shows a three dimensional far field directivity radiation pattern for the antenna of FIG. 5 with feeds 180 degrees out of phase;

FIG. 10 shows a two dimensional directivity radiation pattern for FIG. 9;

DETAILED DESCRIPTION

Figure 1:
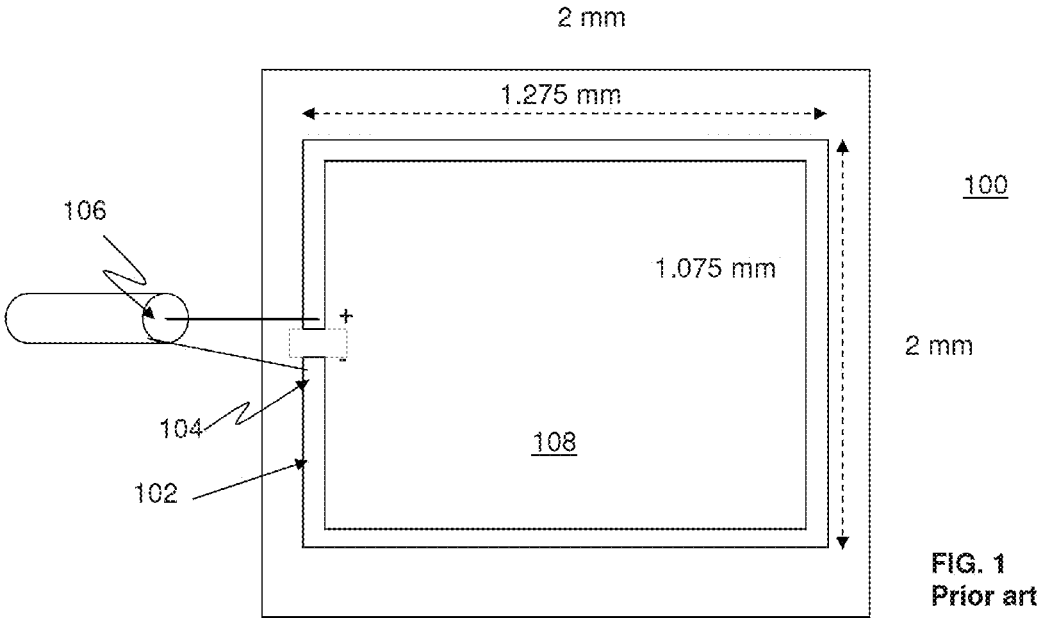
FIG. 1 Prior art
FIG. 1 shows a schematic diagram of a conventional single feed loop antenna.

In the following description: like numerals refer to similar structures or features in the drawings; the term feed-point is used to generally mean a location or point on an antenna radiating element to which a signal may be coupled to or from the radiating element via a feed-line (or transmission line), either by direct connection or indirectly (e.g. aperture feed, or gap feed); and the term feed is used to generally mean an active coupling of signals to or from the antenna radiating element and a transmitter or receiver or other circuit element.

The present matter provides an antenna and method for constructing an antenna which is particularly useful in frequency bands having high path losses and high oxygen absorption of transmitted/received power. An example of such frequency band is the unlicensed band at 60 GHz where the path losses are about 30 dB higher than the 2 GHz band and losses due to oxygen absorption are about 10-15 dB/km. Accordingly antennas having one or more characteristics of high gain, directivity and bandwidth are more useful for these frequency bands. However the antenna and methods described herein are applicable to all frequency bands including cellular bands, UMTS, 802.xxx, CDMA, 3GPP, LTE and not just the 60 GHz band described herein.

The present disclosure provides an antenna and method for constructing an antenna having an improved gain over a corresponding typical single feed point antenna.

Further the present disclosure provides an antenna and method for constructing an antenna having multiple feed points, with radiation patterns that operate constructively for improved gain over a corresponding typical single feed point antenna.

Still further the present disclosure provides an antenna and method for constructing a multiple feed antenna having a steerable beam pattern.

Still further the present disclosure provides an antenna and method for constructing a multiple feed antenna having improved directivity over a corresponding typical single feed point antenna.

In accordance with an embodiment of the present matter there is provided an antenna, comprising a radiating element configured to have a fundamental resonance frequency being regarded as a first harmonic resonance frequency $f_o$; one or more feed points positioned on the configured radiating element at locations that correspond to where a multiple of the first harmonic resonance frequency have current maxima, wherein the feed points are operable to cooperate at an operating frequency of the antenna to constructively combine their respective antenna radiation patterns.

In accordance with a further aspect there is provided that the antenna is selected from antenna types that have a current distribution that is symmetric about a location on the antenna.

In accordance with a further aspect there is provided that the antenna is selected from antenna types that have a current maxima that is symmetric about a location on the antenna.

In accordance with a further aspect the antenna radiation patterns combine to increase at least one of the antenna gain, bandwidth and directivity over that of an equivalent single feed point antenna. Equivalent herein means an antenna dimensioned to have a similar fundamental resonant frequency.

In accordance with another embodiment of the present matter there is provided an antenna for transmitting and receiving radiation, comprising a radiating element configured to have a basic resonance frequency being regarded as a first harmonic resonance frequency $f_o$; feed points positioned at locations on the configured radiating element, the location of the feed points selected to induce constructive combining of respective antenna radiation from the feed points when jointly fed.

In accordance with still further embodiment of the present matter there is provided a method for constructing an antenna comprising configuring a radiating element to have a basic resonance frequency being regarded as a first harmonic resonance frequency $f_o$; determining locations of feed points on the configured radiating element where multiples of the first harmonic resonance frequency have current maxima; and connecting feeds to a number of the determined locations of feed points.

In accordance with an aspect of the method there is further provided selecting the antenna from antenna types that have a current distribution that is symmetric about a location on the antenna.

In accordance with a further aspect of the method there is provided that the antenna is selected from antenna types that have a current maxima that is symmetric about a location on the antenna.

In accordance with an aspect of the method there is further provided operating the antenna at a multiple of the first harmonic resonance frequency.

In accordance with a still further aspect of the method there is further provided determining a desired direction of a radiation pattern of the antenna and configuring a phase between two or more of the feeds to direct the radiation pattern in the desired direction.

In accordance with another embodiment of the present matter there is provided a method for constructing an antenna comprising configuring a radiating element to have a fundamental resonance frequency being regarded as a first harmonic resonance frequency $f_o$; positioning feed points at one or more of multiple locations on the configured radiating element, the locations corresponding to where a harmonic of the first harmonic resonance frequency has current maxima, wherein when the antenna is operated at an operating frequency, the feed points cooperate to constructively combine their respective antenna radiation patterns to increase at least one of the antenna gain and bandwidth over that of an equivalent single feed point antenna.

In accordance with a still further aspect one or more feeds are applied to respective feed points are different in phase to others of feeds applied to corresponding others of feed points to steer the antenna beam pattern.

In accordance with a still further aspect operation of connected feed points are alternated in time.

In accordance with a still further aspect feed points are operated simultaneously.

In accordance with a still further aspect the configuring a phase includes configuring a phase tuning element.

Referring to FIG. 1 there is shown geometry of a conventional single feed point loop antenna 100. The antenna 100 includes a radiating element composed of a rectangular loop conductor 102 with a single feed point 104, configured for a single a differential feed connection to, for example, a coaxial cable 106. The radiating element 102 is printed on a major surface of a substrate 108. In the present example the substrate is Pyralux TK, with a relative dielectric constant $\epsilon r$=0.5, and loss tangent tan Delta=0.002. A thickness of the substrate 108 is 0.1 mm, while when the antenna is backed by a solid conductor (not shown), the thickness is increased to 0.75 mm. The antenna 100 is dimensioned to operate at a first harmonic or fundamental frequency of 60 GHz. In the illustrated example the substrate size is 2 mm by 2 mm and the rectangular loop is 1.275 mm by 1.075 mm by 0.1 mm. Other substrates, antenna dimensions and antenna types may be also be implemented provided that the overall antenna dimensions ensure that the antenna resonates at the fundamental resonance frequency and the feed point placement and operating frequency of the antenna observe the design principles described herein. For example while a rectangular loop is shown in the present embodiment, later in the description dipole antenna embodiments are described. As will be appreciated other shapes and types of antennas may also be used. Various techniques for constructing the antennas described herein will be known to those in the art. However for simplicity of description, it is assumed that the antennas described herein are constructed on a suitable planar substrate.

Figure 2:
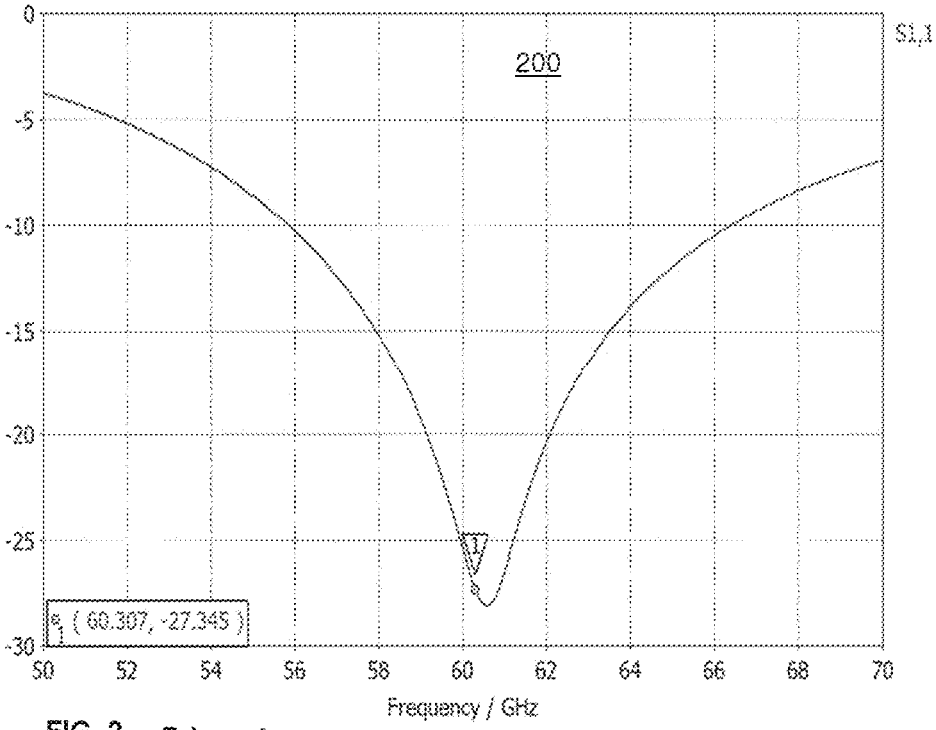
FIG. 2 Prior art
FIG. 2 shows a graph of reflection coefficient versus frequency for the antenna of FIG. 1.
Figure 3:
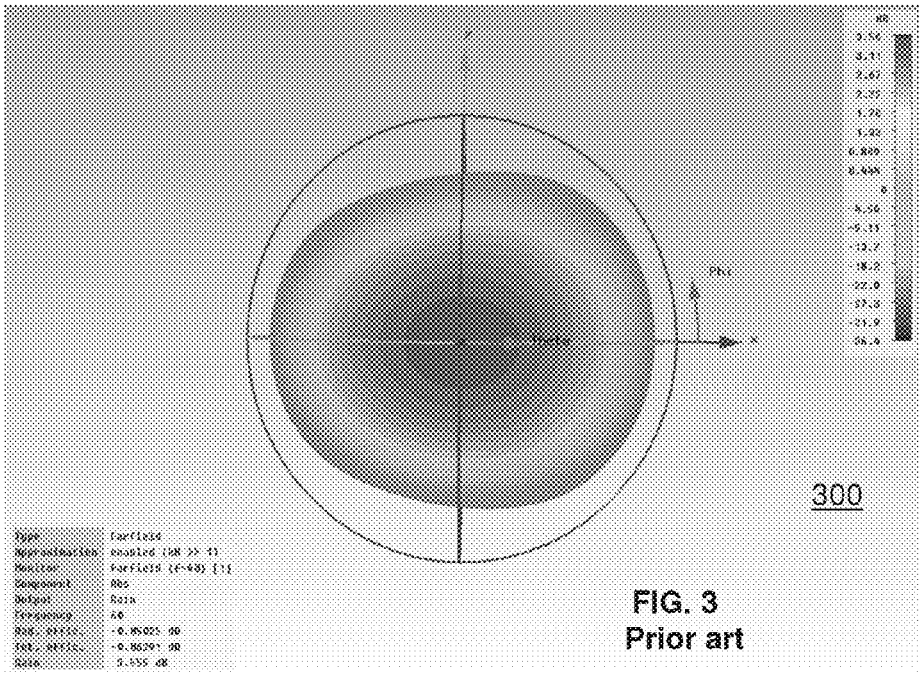
FIG. 3 Prior art
FIG. 3 shows a three dimensional far field directivity radiation pattern for the antenna of FIG. 1.
Figure 4:
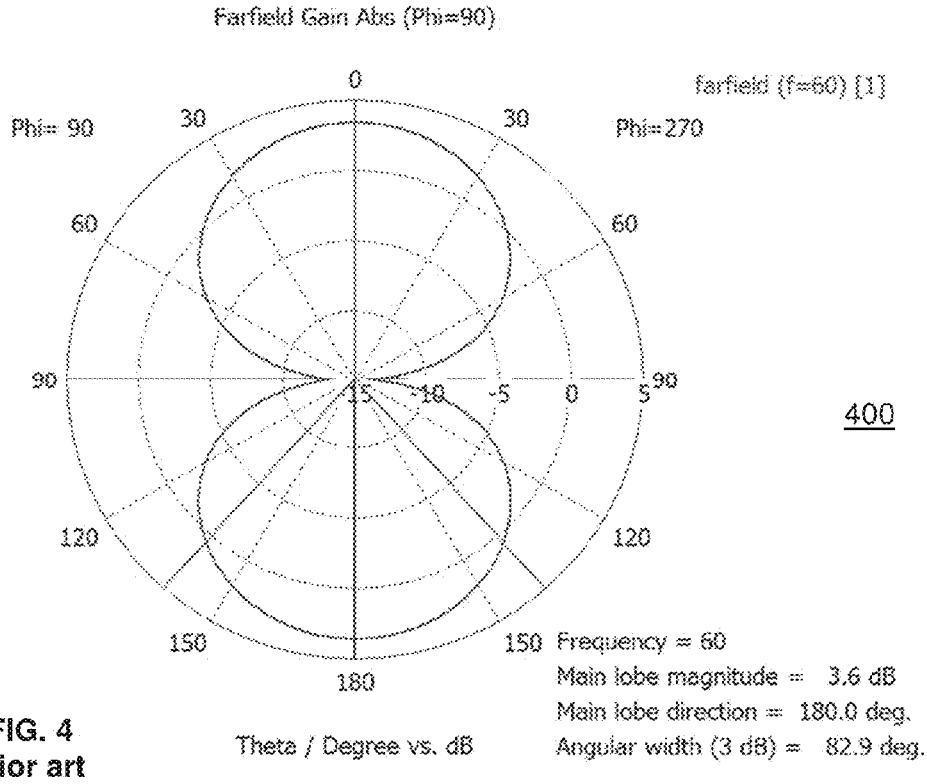
FIG. 4 Prior art
FIG. 4 shows a two dimensional directivity radiation pattern of the antenna of FIG. 1.

Various performance characteristics of the antenna 102 when modeled are shown in FIGS. 2, 3 and 4, wherein FIG. 2 shows a graph of reflection coefficient versus frequency for a modeled antenna 100, FIG. 3 shows a three dimensional far field directivity radiation pattern for the modeled antenna and FIG. 4 shows a two dimensional directivity radiation pattern of the modeled antenna 102. For clarity, the graph of FIG. 3 is referenced to the antenna positioned with its major surface in the plane of the paper (in the plane of the x-y axis of FIG. 3) with the feed point oriented to the left; similarly the graph of FIG. 4 (elevation plane) is referenced to the antenna positioned with its major surface perpendicular to the paper along the 90-90 degree line. In other words FIG. 4 is a cross sectional slice along the phi=90-270 degree line (y-axis) in FIG. 3. For conciseness it is assumed that the antenna is oriented similarly in all graphs shown and described herein unless otherwise stated.

As may be seen in FIG. 2 the reflection coefficient is at a minimum at a frequency of just over 60 GHz. Referring back to FIG. 4, a maximum directivity is 3.6 dBi at 60 GHz with a main lobe direction at 180 degrees and beamwidth of 82.9 degrees. The realized gain (gain multiplied by the reflection coefficient) is calculated to be 3.5 dBi at 60 GHz. If the bandwidth of the antenna 100 is defined at −10 dB return loss, then FIG. 2 indicates that bandwidth is 10 GHz.

Figure 5:
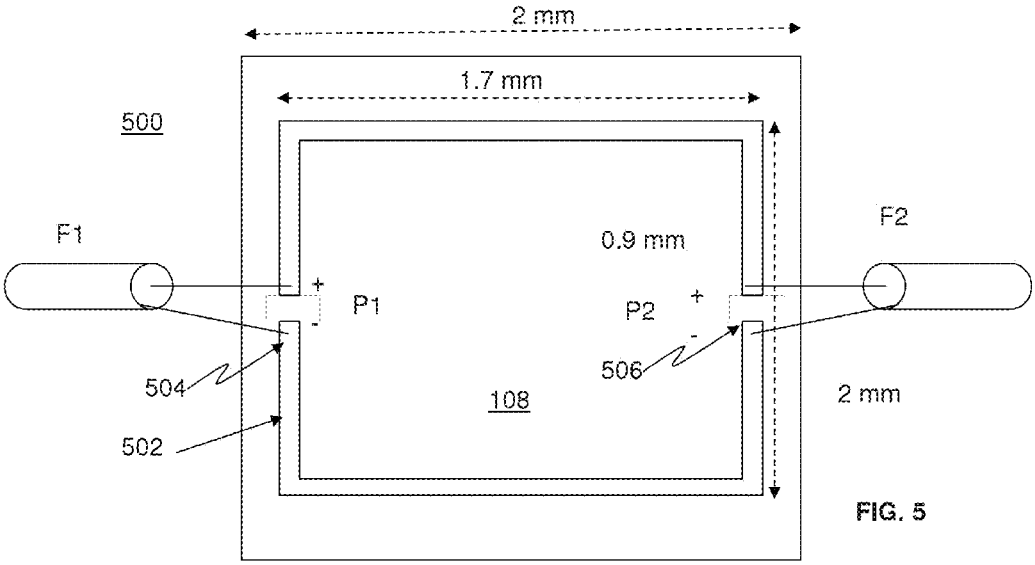
FIG. 5 shows the geometry of a two feed point antenna according to an embodiment of the present matter.
Figure 6:
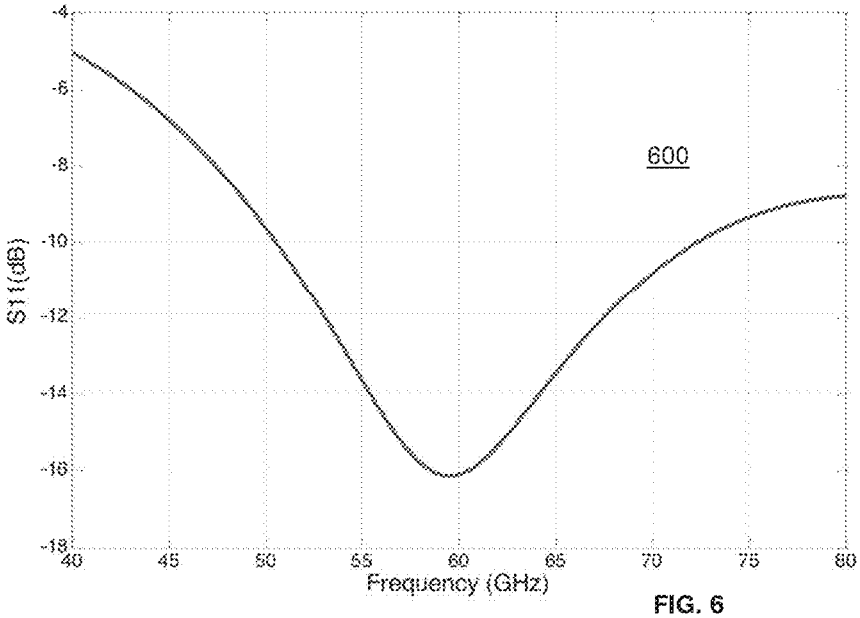
FIG. 6 shows a graph of reflection coefficient versus frequency for the antenna of FIG. 5.
Figure 7:
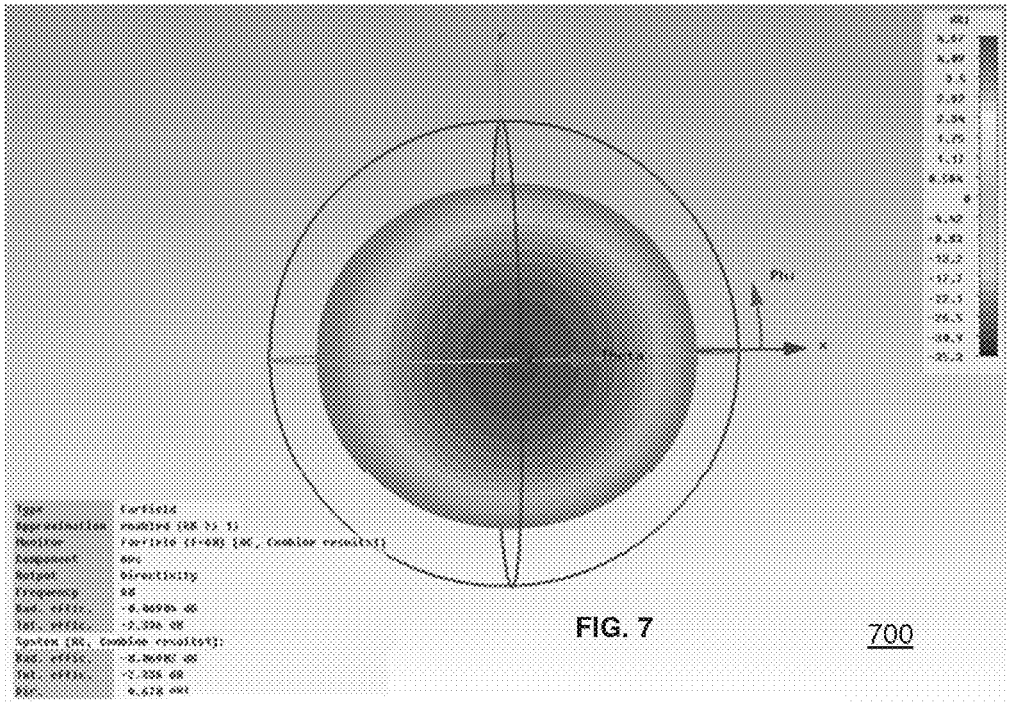
FIG. 7 shows a three dimensional far field directivity radiation pattern for the antenna of FIG. 5.
Figure 8:
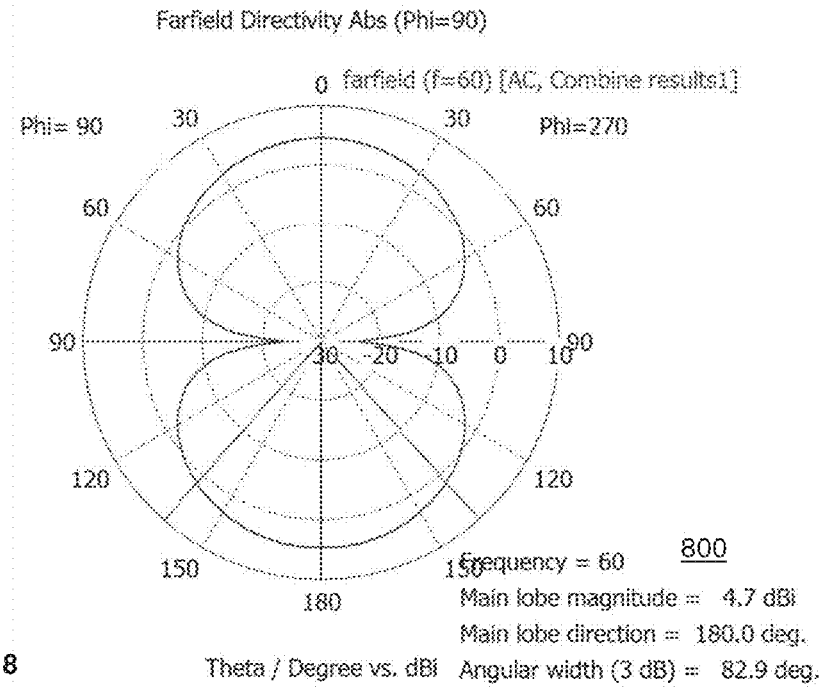
FIG. 8 shows a two dimensional directivity radiation pattern of the antenna of FIG. 5

Referring to FIG. 5 there is shown the geometry of a two feed point antenna 500 according to an embodiment of the present matter. The antenna 500 includes a radiating element composed of a rectangular loop conductor 502 with two feed points 504, 506. The antenna 500 is dimensioned to operate at a first harmonic frequency or fundamental frequency of 60 GHz. In the illustrated example the substrate size is also 2 mm by 2 mm and the rectangular loop formed on a surface of the substrate is 1.7 mm by 0.9 mm by 0.1 mm (strip width). The feed points 504 and 506 are placed at locations P1 and P2 on the radiating element where a modeled current distribution (not shown) at a second harmonic of the fundamental frequency (2×60 GHz) has a maxima. For the rectangular loop 502 this occurs at locations P1, P2 which are in symmetry about a notional central dividing line through the rectangular loop 502. The various performance characteristics of the antenna 500 when modeled. While a backing conductor (formed on a surface of the substrate opposing the surface on which the radiating element is formed) may be used in all of the embodiments. The modeled characteristics are shown in FIGS. 6, 7 and 8, without a backing conductor, wherein FIG. 6 shows a graph of reflection coefficient versus frequency for a modeled antenna 500, FIG. 7 shows a three dimensional far field directivity radiation pattern for the modeled antenna and FIG. 8 shows a two dimensional directivity radiation pattern for the modeled antenna 500. As may be seen in FIG. 6 the reflection coefficient is at a minimum at around 60 GHz. FIG. 8 shows a maximum directivity of 4.7 dBi at 60 GHz with a main lobe direction at 180 degrees and beam width of 82.9 degrees. The realized gain is calculated to be 4.5 dBi at 60 GHz. If the bandwidth of the antenna 500 is defined at −10 dB return loss, then FIG. 6 indicates that bandwidth is 22 GHz. Thus based on the modeled results, the antenna 500 shows a 29% improvement in directivity, a 28.5% improvement in realized gain and a 120% improvement in bandwidth over the conventional single fed antenna 100. In this embodiment, the differential antenna feeds F1 and F2 are in phase and both operate simultaneously at the fundamental or first harmonic frequency of 60 GHz.

While the antenna radiation pattern for the pair of in phase feeds F1 and F2 is shown in FIGS. 7 and 8, it has been found that the antenna radiation pattern may be steered or changed without significant change in the main lobe magnitude. For instance, if the location P1 and P2 of the feed points are maintained the same in the antenna 500, but the phase of the feeds F1 and F2 are changed by 180 degrees (by for example reversing the polarity of one of the feeds F1 or F2 in FIG. 6) the radiation pattern of the antenna 500 is changed as shown in FIGS. 9 and 10. FIG. 9 shows a three dimensional far field directivity radiation pattern for the antenna 500, having feeds at 180 degrees out of phase, operating at 60 GHz and FIG. 10 shows the corresponding two dimensional directivity radiation pattern. As may be seen, the main lobe magnitude is 6.3 dBi at 90 degrees with an angular width of 94.6 degrees while maintaining the same bandwidth as the in phase feeds. The VSWR plot is similar to FIG. 6. Although two examples of phasing between feed points have been described herein, the phase between feeds is not limited to these illustrated examples, but may be varied by any desirable amount (not only 0 degrees or 180 degrees as illustrated herein) in order to direct or steer the antenna beam in a particular direction. Thus according to another aspect of the embodiment the antenna radiation pattern may be steered by controlling the phase between the multiple constructive feeds. As will be appreciated phasing between feeds may be implemented in various ways. For example phase tuning elements (not shown) such as a capacitor, transmission line, MEMs switch or such like may be used (in series or parallel connection) with one or more of the feeds in order to steer a beam in a desired direction. While such phase tuning elements may introduce a slight loss in the signal path, such loss is insubstantial when compared to the net gain/directivity improvements obtained by the antenna configurations according to the present matter.

Figure 11:
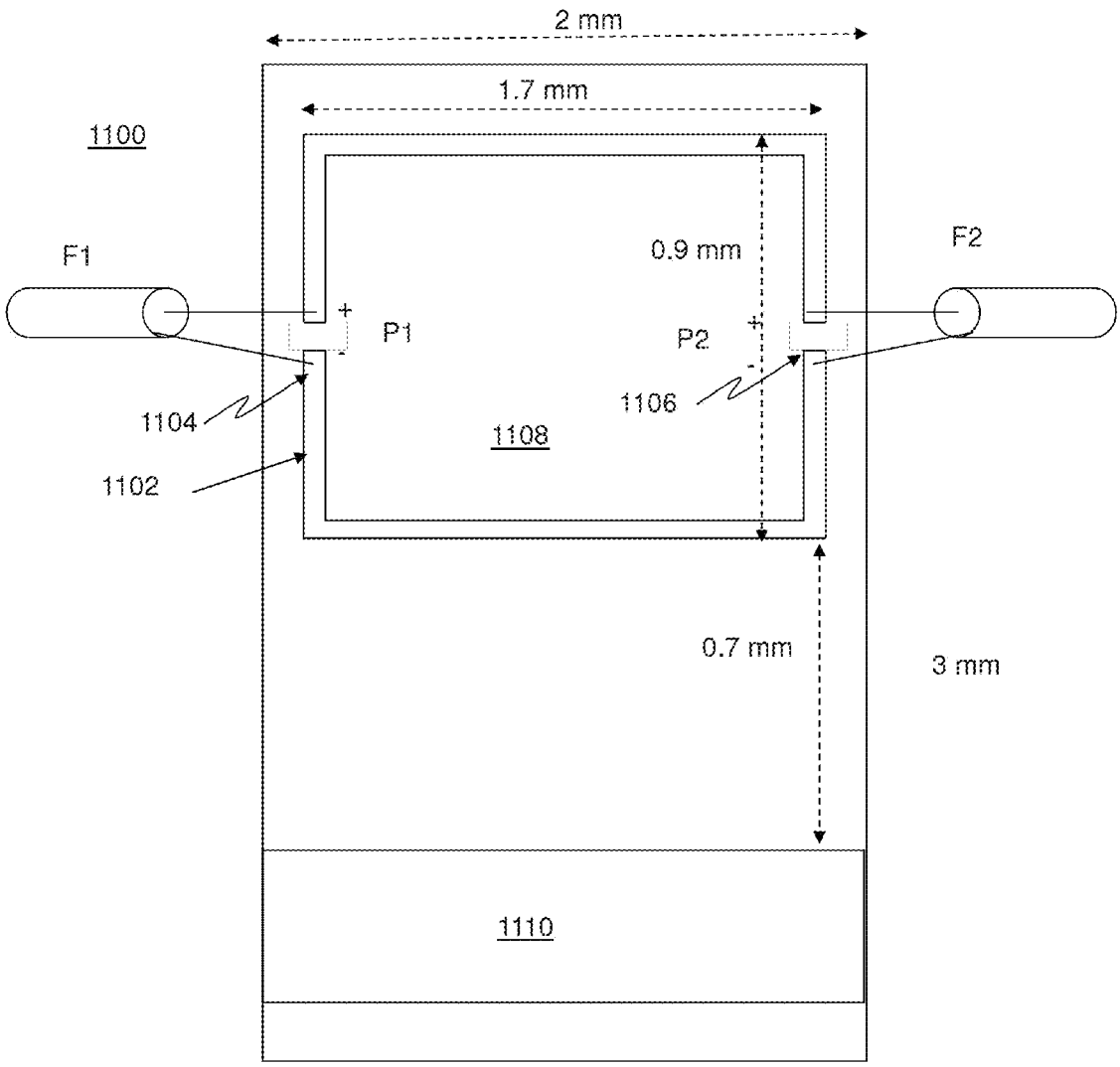
FIG. 11 shows the geometry of an antenna including a reflector according to an embodiment of the present matter.
Figure 12:
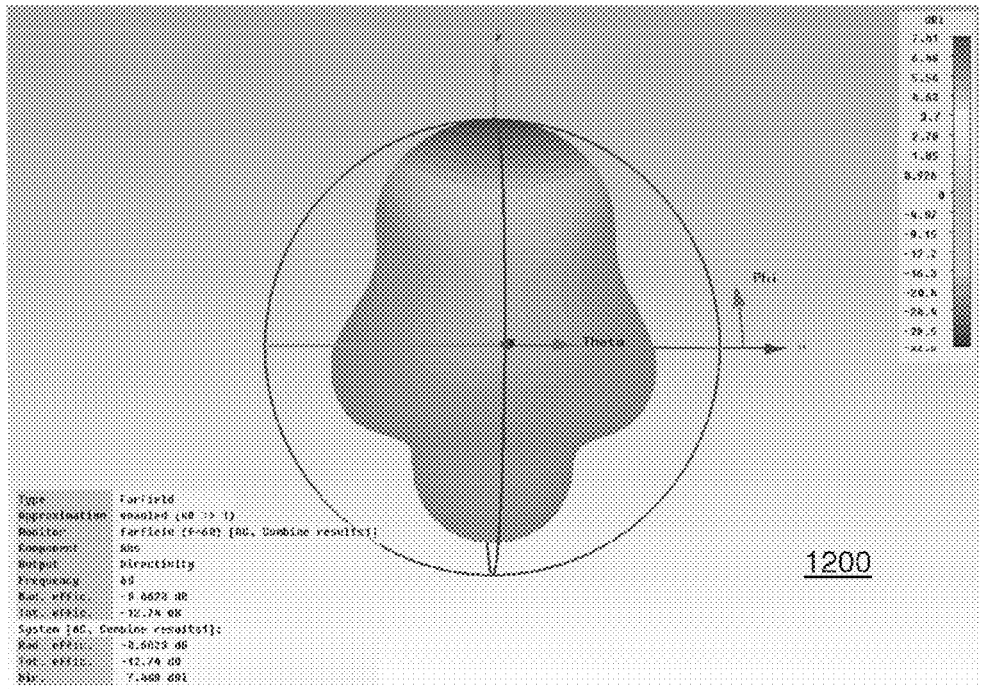
FIG. 12 shows a three dimensional far field directivity radiation pattern for the antenna of FIG. 11.
Figure 13:
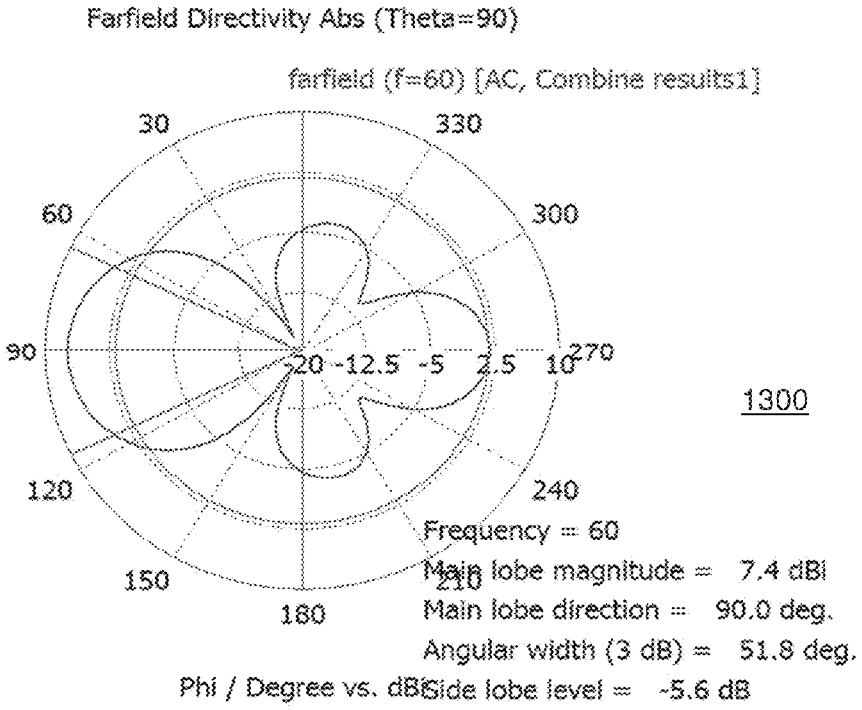
FIG. 13 shows a two dimensional directivity radiation pattern for FIG. 11.

In another embodiment, a reflector may be used with the antenna to induce a more directed beam, while maintaining the achieved gains from having the multi-feeds. Referring to FIG. 11 there is shown the geometry of an antenna 1100 including a reflector 1110. The antenna arrangement 1100 is similar to the antenna 500 with the addition of the reflector 1100 and an accordingly extended substrate to accommodate the reflector. The reflector may take any suitable shape, however as illustrated in the present embodiment the reflector 1110 is a rectangular metal patch formed on the same surface of the substrate as the radiating element. For the illustrated embodiment 1100 the substrate is 2 mm by 3 mm and the reflector is positioned a distance 0.7 mm from the rectangular loop 1102. FIGS. 12 and 13 show the corresponding radiation pattern with the reflector. Again in this instance the feeds F1 and F2 are 180 degrees out of phase. As may be seen from FIGS. 12 and 13, the main lobe in this instance is 7.4 dBi in a 90 degree direction (assuming 0 degrees is perpendicular to the major plane of the antenna), with a beam width of 51.8 degrees and a side lobe level at −5.6 dBi.

Figure 14:
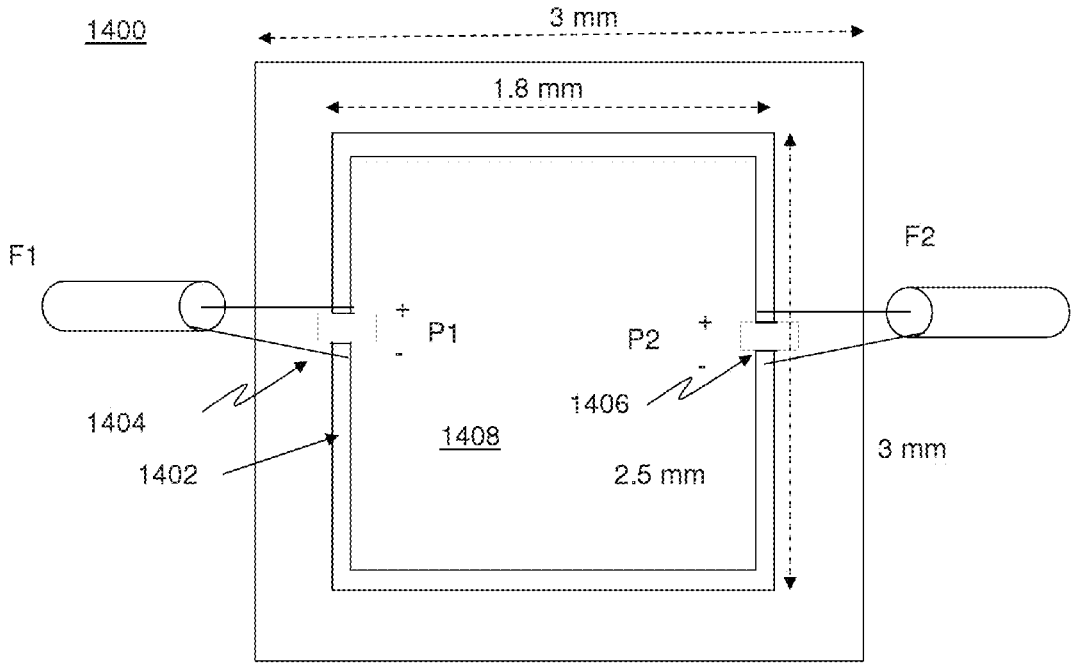
FIG. 14 shows the geometry of a two feed point antenna according to another embodiment of the present matter.

Referring to FIG. 14 there is shown the geometry of a two feed point antenna 1400 according to another embodiment of the present matter. In this embodiment the antenna 1400 is also a two feed point antenna rectangular loop antenna similar to the previously described antenna 500. However the antenna 1400 is configured to operate at a second harmonic of the fundamental frequency. In other words, the antenna 500 has an operational frequency of 60 GHz, but the dimensions of the rectangular loop 1402 correspond to a first harmonic resonance or fundamental frequency of 30 GHz. Thus the antenna 1400 is constructed on a surface of a 3 mm by 3 mm substrate, with the rectangular loop radiating conductor 1402 having dimensions of 1.8 mm by 2.5 mm by 0.1 mm.

The feed points 1404 and 1406 are placed at locations P1 and P2 on the radiating element 1402 where the modeled current distribution (not shown) at a second harmonic of the fundamental frequency (2×30 GHz) has a maxima. For the rectangular loop 1402 this occurs at locations P1, P2 which like the previous antenna 500 are in symmetry about a notional central dividing line through the rectangular loop 1402. The respective differential antenna feeds F1 and F2 are in phase (the phase between P1 and P2 is zero) and both operate simultaneously at the second harmonic frequency of 60 GHz.

Figure 15:
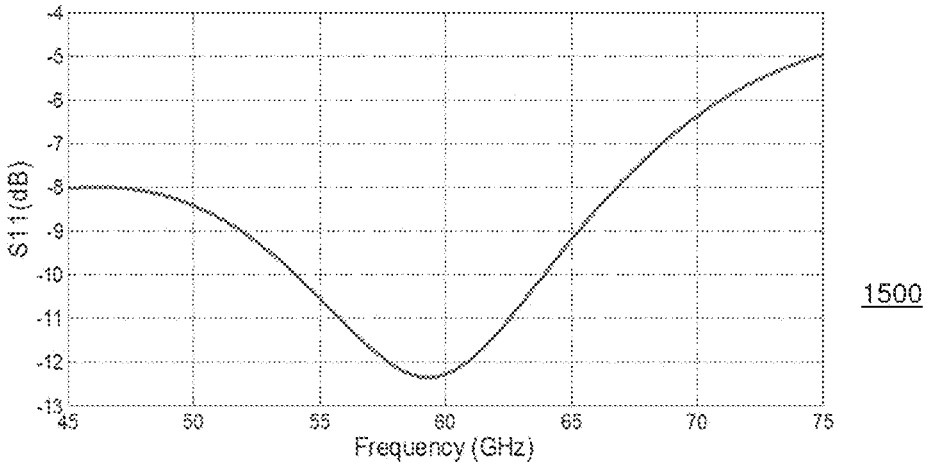
FIG. 15 shows a graph of reflection coefficient versus frequency.
Figure 16:
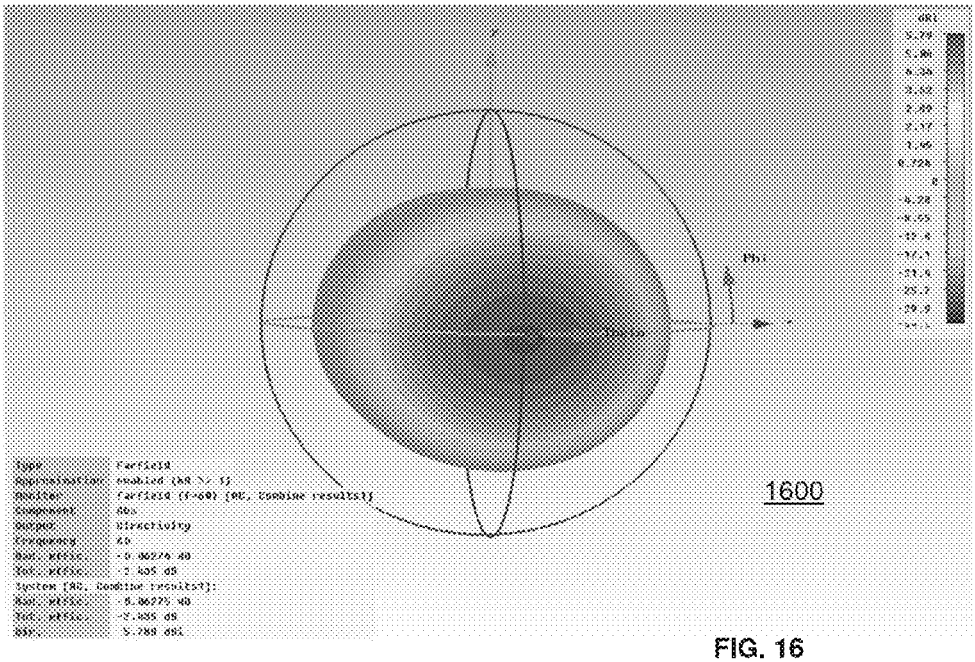
FIG. 16 shows a three dimensional far field directivity radiation pattern.
Figure 17:
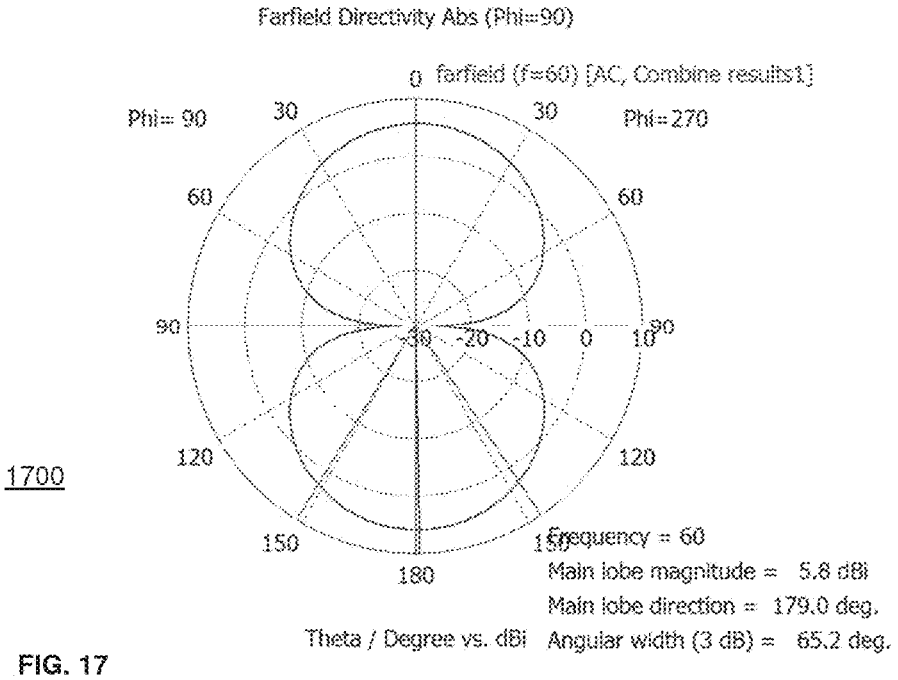
FIG. 17 shows a two dimensional directivity radiation pattern corresponding to FIG. 16.

The various performance characteristics of the antenna 1400 are modeled for the operating frequency of 60 GHz and are shown in FIGS. 15, 16 and 17, wherein FIG. 15 shows a graph of reflection coefficient versus frequency, FIG. 16 shows a three dimensional far field directivity radiation pattern and FIG. 17 shows a corresponding two dimensional directivity radiation pattern. As may be seen in FIG. 15 the reflection coefficient is at a minimum at around 60 GHz. FIG. 17 shows a maximum directivity of 5.8 dBi at 60 GHz with a main lobe direction at 179 degrees and beam width of 65.2 degrees. The realized gain is calculated to be 5.69 dBi at 60 GHz. FIG. 15 indicates that bandwidth of antenna 1400 is 11 GHz. Thus based on the modeled results, the antenna 1400 shows a 60% improvement in directivity, a 62% improvement in realized gain and a 10% improvement in bandwidth over the conventional single fed loop antenna 100.

Figure 18:
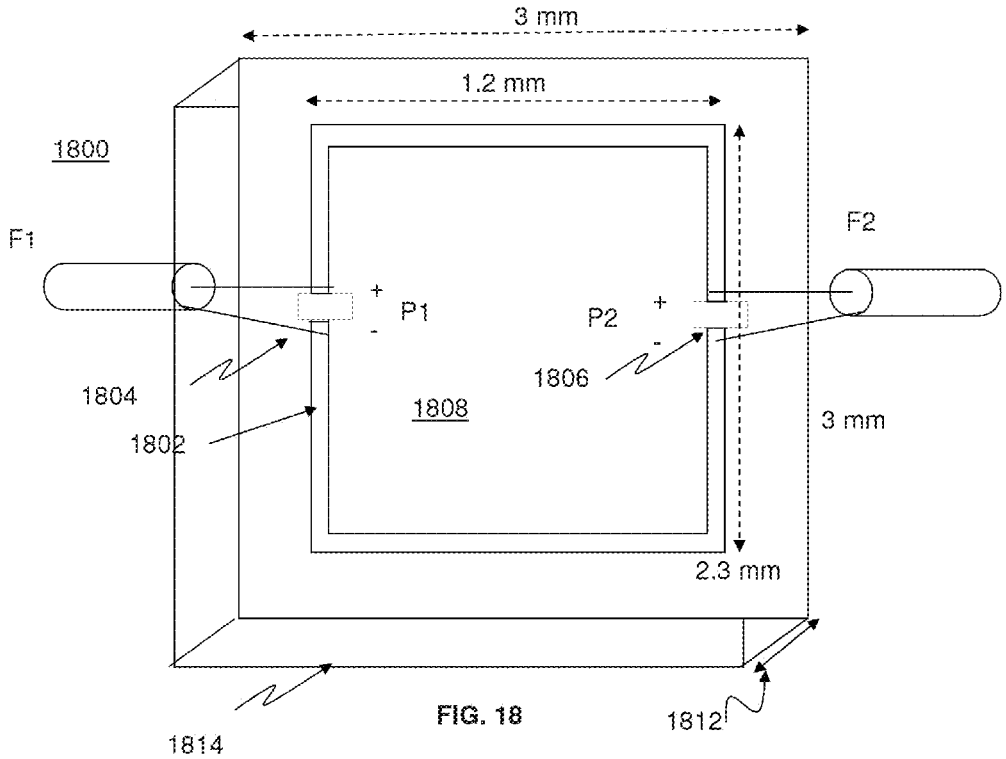
FIG. 18 shows the geometry of a two feed antenna according to a still further embodiment of the present matter.

Referring to FIG. 18 there is shown the geometry of a two feed antenna 1800 according to a still further embodiment of the present matter. In this embodiment the antenna 1800 is also a two feed antenna rectangular loop 1802 antenna similar to the previously described antenna 1400 operating at a second harmonic. However the directivity of the antenna 1800 is increased by adding a conductor as a ground 1814 to the loop antenna structure. In this case the substrate 1808 thickness 1812 is $\lambda/4$ (at 30 GHz). After adding the ground conductor 1814, the dimensions of the antenna rectangular loop 1802 are adjusted to have sides of 1.2 mm by 2.3 mm by 0.1 mm wide (strip width). In the illustrated embodiment the ground conductor 1814 is planar has rectangular dimensions similar to the substrate 1808 however different dimensioned ground conductors may also be used that are for example smaller or larger than the rectangular dimension of the loop.

The respective differential antenna feeds F1 and F2 are in phase (the phase between P1 and P2 is zero) and both operate simultaneously at the second harmonic frequency of 60 GHz.

Figure 19:
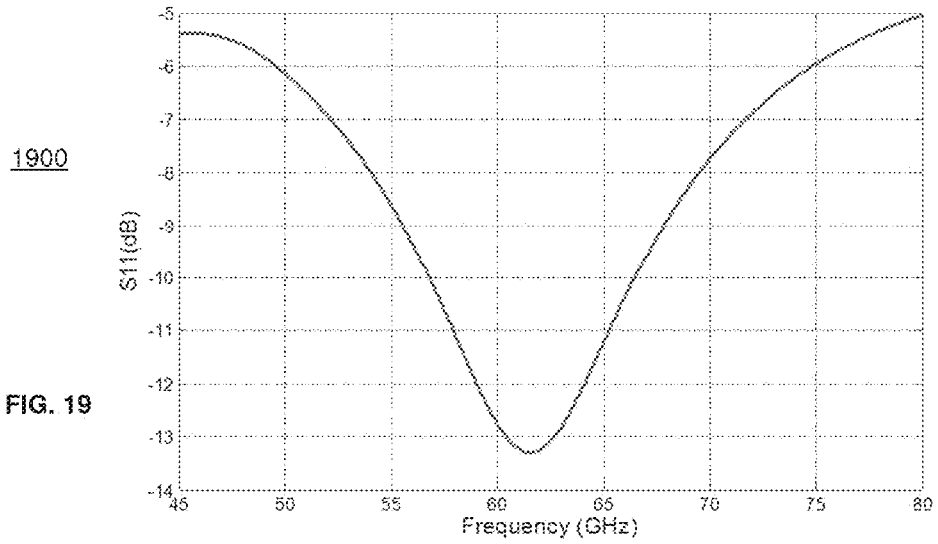
FIG. 19 shows a graph of reflection coefficient versus frequency for the antenna of FIG. 18.
Figure 20:
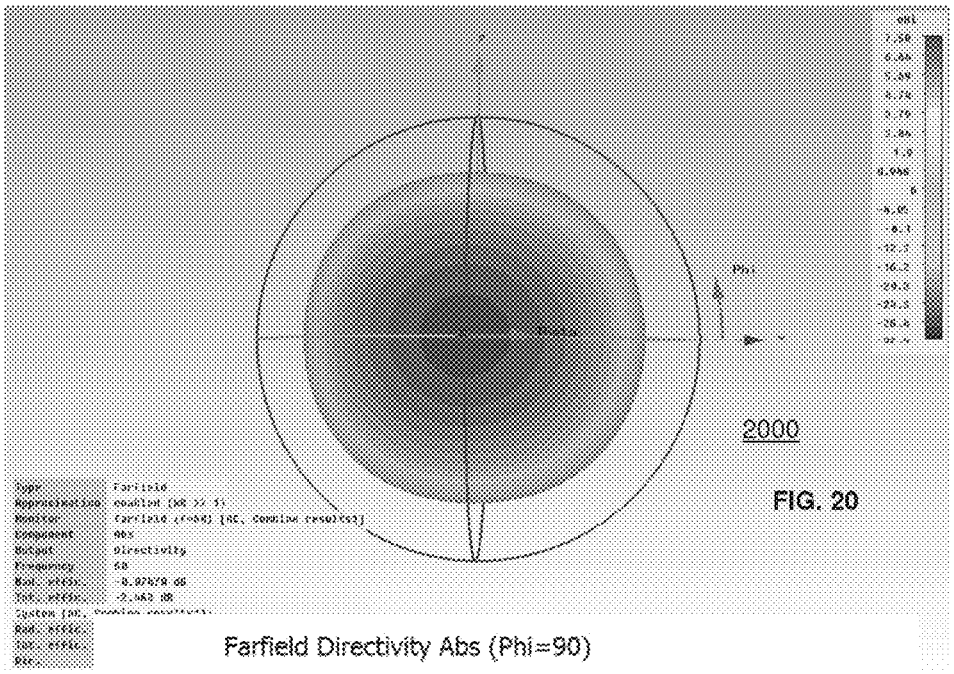
FIG. 20 shows a three dimensional far field directivity radiation pattern for the antenna of FIG. 18.
Figure 21:
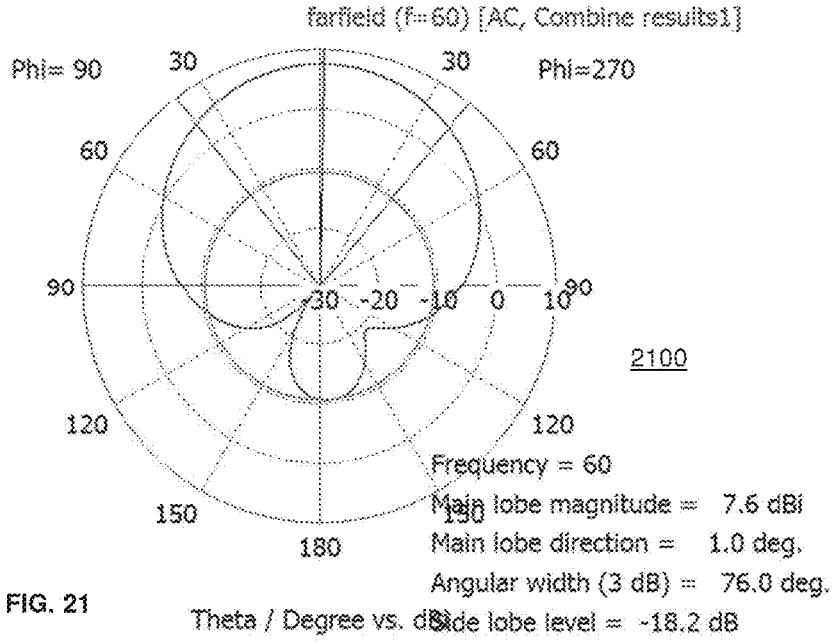
FIG. 21 shows a two dimensional directivity radiation pattern for the antenna of FIG. 18.

The various performance characteristics of the antenna 1800 are modeled for the operating frequency of 60 GHz and are shown in FIGS. 19, 20 and 21, wherein FIG. 19 shows a graph of reflection coefficient versus frequency, FIG. 20 shows a three dimensional far field directivity radiation pattern and FIG. 21 shows a corresponding two dimensional directivity radiation pattern. As may be seen in FIG. 19 the reflection coefficient is at a minimum at around 60 GHz. FIG. 21 shows a maximum directivity of 7.58 dBi at 60 GHz with a main lobe direction at 1 degrees and beam width of 76 degrees. The realized gain is calculated to be 7.47 dBi at 60 GHz. FIG. 15 indicates that bandwidth of antenna 1800 is 10 GHz. Thus based on the modeled results, the antenna 1800 shows a 110% improvement in directivity, a 113% improvement in realized gain and a slight improvement in bandwidth over the conventional single fed loop antenna 100.

Figure 22:
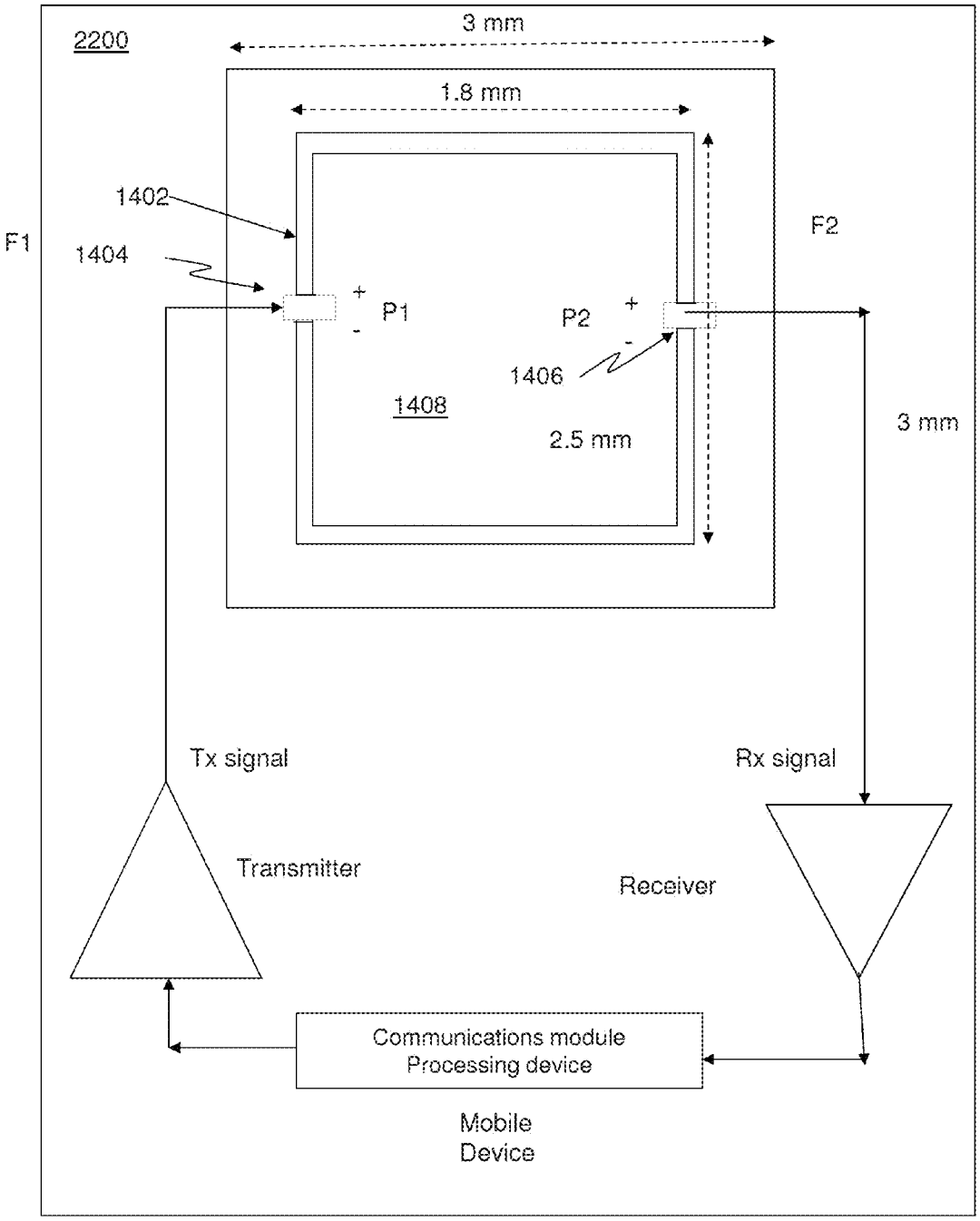
FIG. 22 shows an arrangement of a self-duplexing transceiver using antenna according to an embodiment of the present matter.

Referring to FIG. 22 there is shown an arrangement 2200 of a dual-feed loop antenna 2202 coupled to a transmitter 2201 and receiver 2203 in a duplexed signal configuration. The signal output F1 from the transmitter 2201 is coupled to one of the feed points P1 on the antenna and the signal input F2 to the receiver is coupled from the other feed point P2. Both the transmitter and receiver operate at the same frequency e.g. 60 GHz. The antenna 2202 may be designed as a dual feed antenna to operate at a multiple of the first harmonic resonant frequency or at the resonant frequency in accordance with the principles described herein.

While the antenna does not operate with simultaneous feed signals (i.e. the signal feeds are duplexed) this sacrifices the increase in antenna gain described herein, but has the advantage of being able to feed both the receiver input and the transmitter output with the same antenna. Particularly in time division duplex (TDD) systems, where the transmitter and receiver are on at different times and filtering is not required, this allows the TX and RX to use the same antenna. Since 60 GHz transceivers and radios don't typically use switches for duplexing and if they do, the switch losses are usually quite significant (2 dB or more). Instead, separate antennas are used for the TX and RX, to avoid these switching losses.

However the dual feed loop antenna arrangement 2200 allows both the TX and RX signals to be fed into the same antenna. This saves significant area over the separate antennas and is lower loss than using a switch.

When the TX signal is fed into the antenna, the receiver is inactive meaning it presents a passive load (likely 50 Ohm or matched) to the antenna port it is attached to. When the RX is active, the transmitter is off and presents a passive load to the antenna port. It may be seen that other applications of the multifeed feed antenna according to the present matter may also be evident to those skilled in the art.

Figure 23:
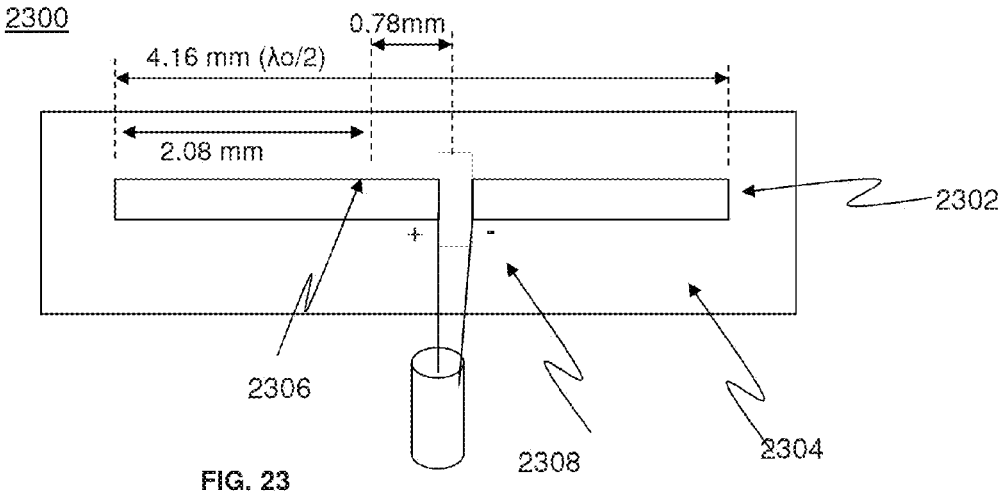
FIG. 23 shows a geometry of a dual feed point dipole antenna according to another embodiment of the present matter.

Referring to FIG. 23 there is shown a geometry of a dual feed point dipole antenna 2300 according to another embodiment of the present matter. The dipole 2300 comprises a metallic trace radiating element 2302 of length 4.16 mm (based on a fundamental resonance frequency of 30 GHz) and 0.2 mm wide formed on a suitable substrate 2304 as for example described herein. The dual feed dipole antenna 2300 operates at a second harmonic operation frequency of 60 GHz and the feed point 2308 is located at a distance of 0.78 mm from a midpoint 2306 of the radiating element 2302 at a location of current maxima when the antenna is excited at the second harmonic of the fundamental frequency (30 GHz) of the antenna. As will be appreciated, a traditional single feed half wave dipole antenna is fed from the midpoint 2306 rather than off centre as in the present matter.

Figure 24:
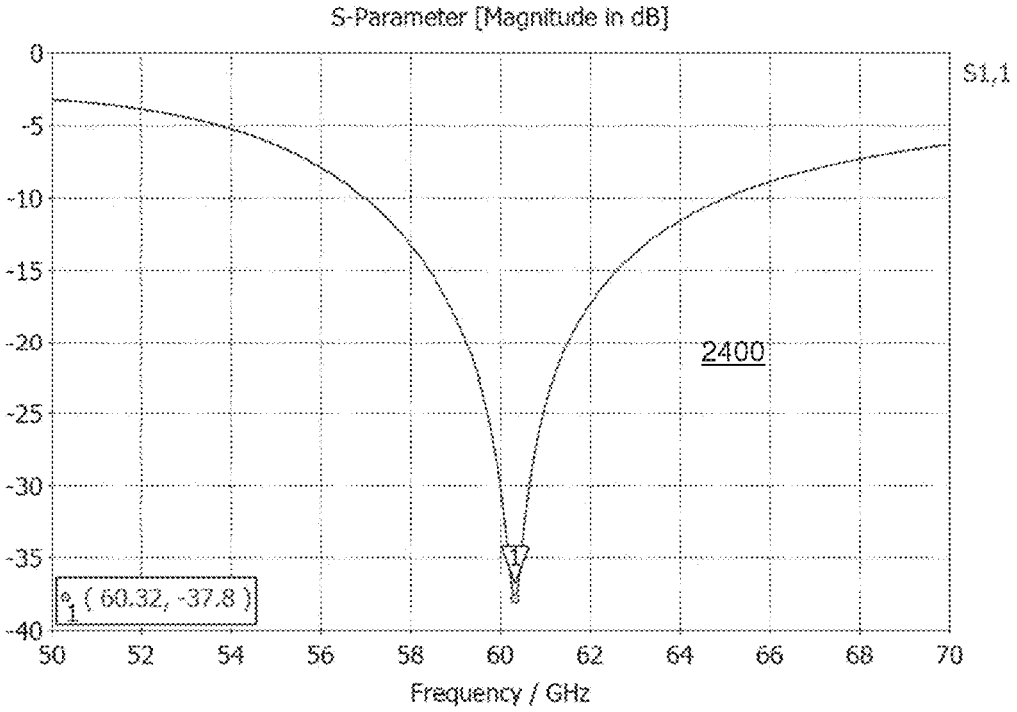
FIG. 24 shows a graph of reflection coefficient versus frequency for the antenna of FIG. 23.
Figure 25:
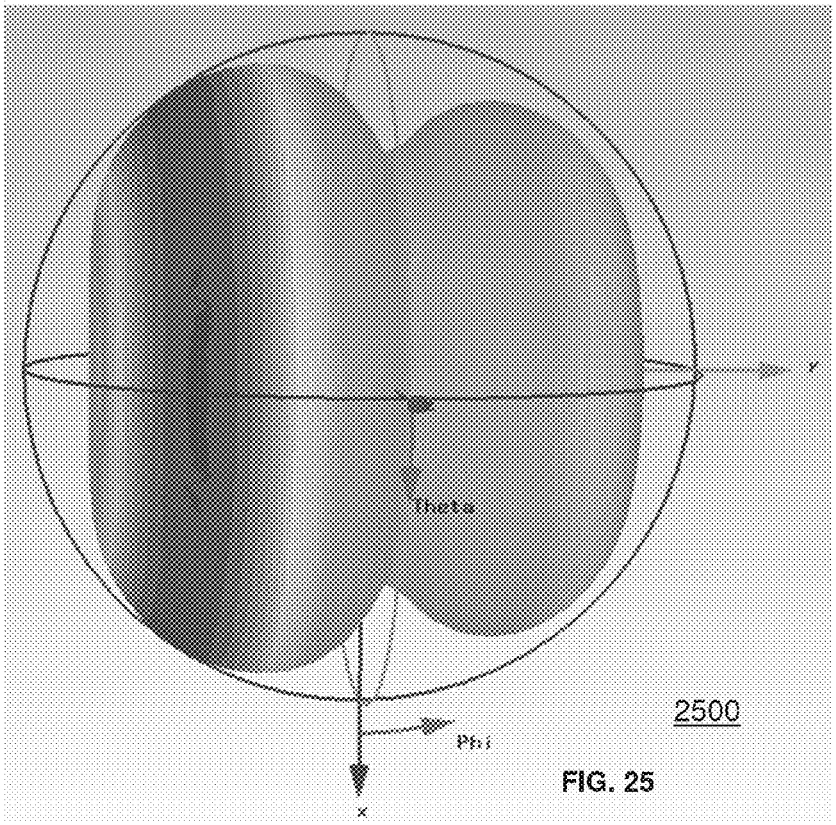
FIG. 25 shows a three dimensional far field directivity radiation pattern for the antenna of FIG. 23.
Figure 26:
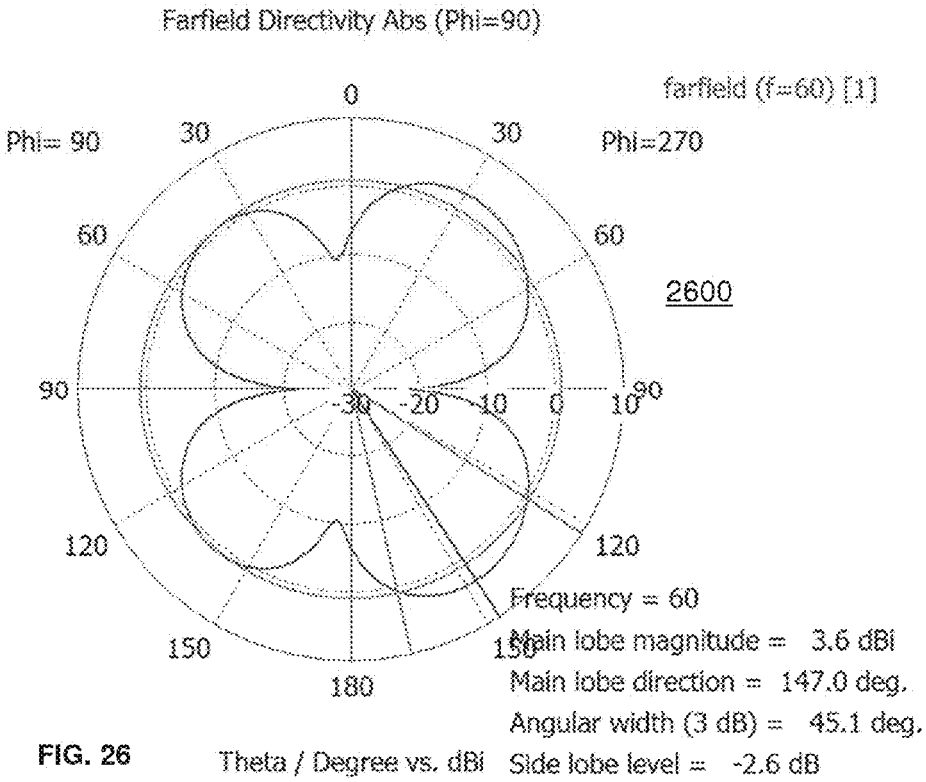
FIG. 26 shows a two dimensional directivity radiation pattern for the antenna of FIG. 23.

The various performance characteristics of the off centre single fed half wave dipole antenna 2300 are modeled for the second harmonic (60 GHz) of the operating frequency and are shown in FIGS. 24, 25 and 26, wherein FIG. 24 shows a graph of reflection coefficient versus frequency, FIG. 25 shows a three dimensional far field directivity radiation pattern and FIG. 26 shows a corresponding two dimensional directivity radiation pattern. As may be seen from FIG. 24 the reflection coefficient is at a minimum at around 60 GHz with a-10 dBi return loss bandwidth of about 9 GHz. FIG. 26 shows a maximum directivity of 3.58 dBi at 60 GHz with a main lobe direction at 147 degrees and beam width of 45.1 degrees. The directivity is higher is higher than the directivity of the first harmonic achieved by traditional A/2 dipole antennas 2.2 dBi. The realized gain is calculated to be 3.49 dBi at 60 GHz.

Thus the antenna 2300 when operated at the second harmonic offers higher directivity in comparison with operating a traditional half wave dipole at the first harmonic that is fed at the center.

Figure 27:
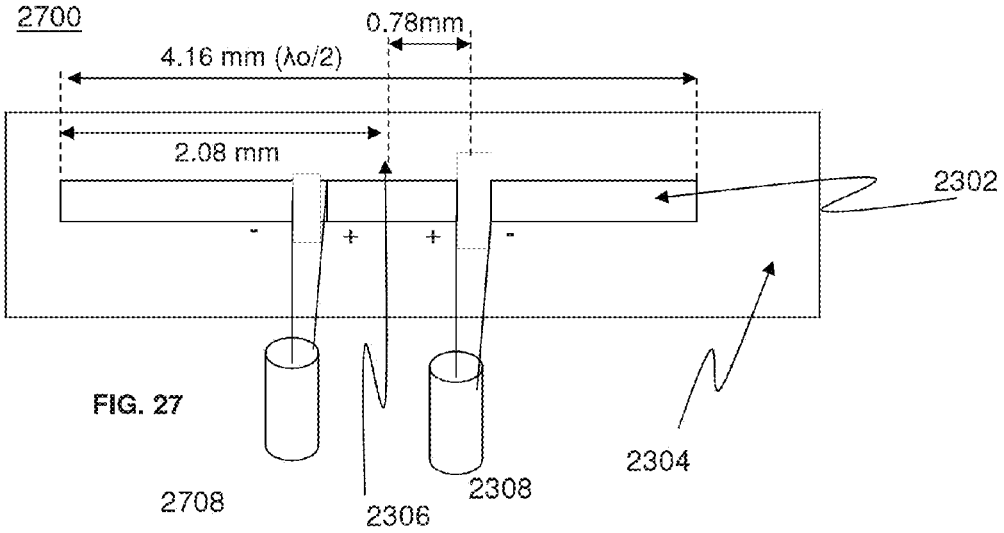
FIG. 27 shows a two feed point half wave dipole according to another embodiment of the present matter.
Figure 28:
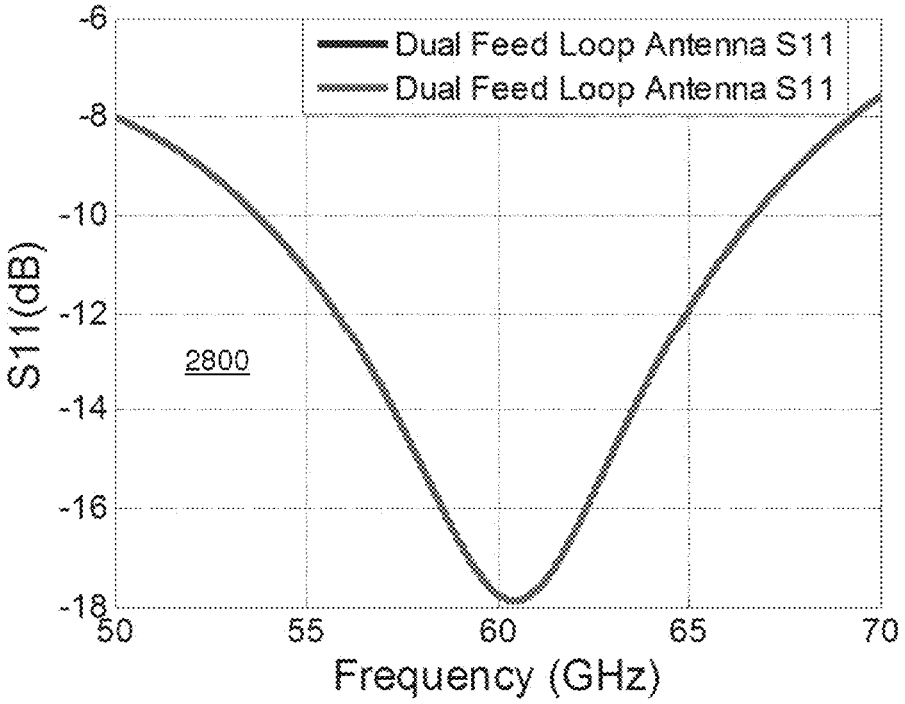
FIG. 28 shows a reflection coefficient of the antenna of FIG. 27 operated at a second harmonic of the fundamental.
Figure 29:
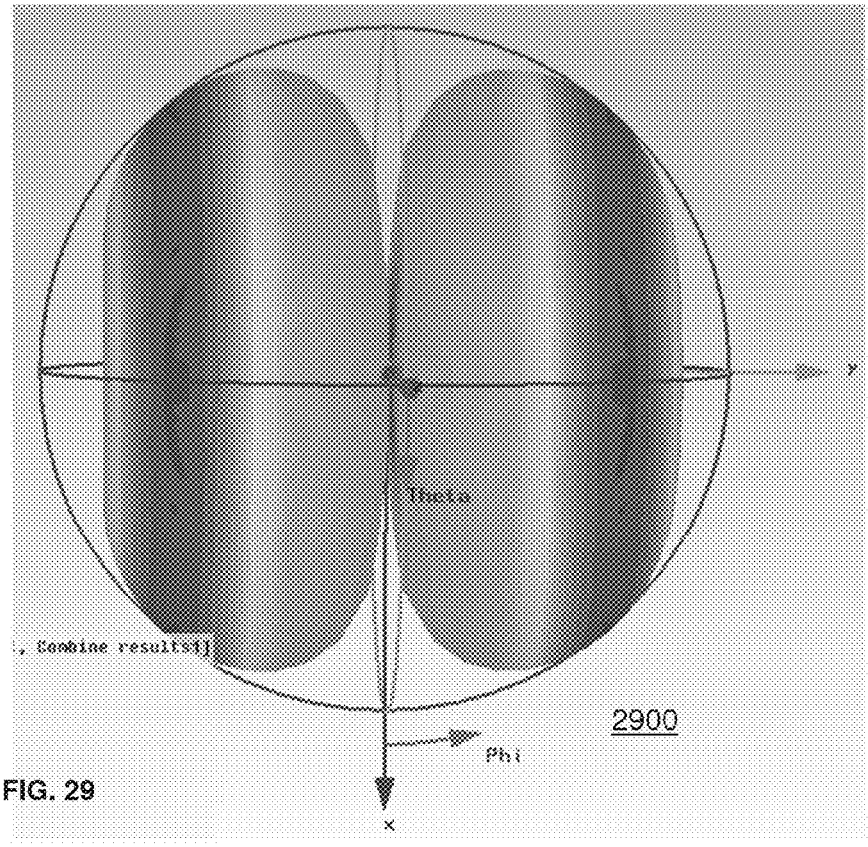
FIG. 29 shows a three dimensional far field directivity radiation pattern for the antenna of FIG. 27.
Figure 30:
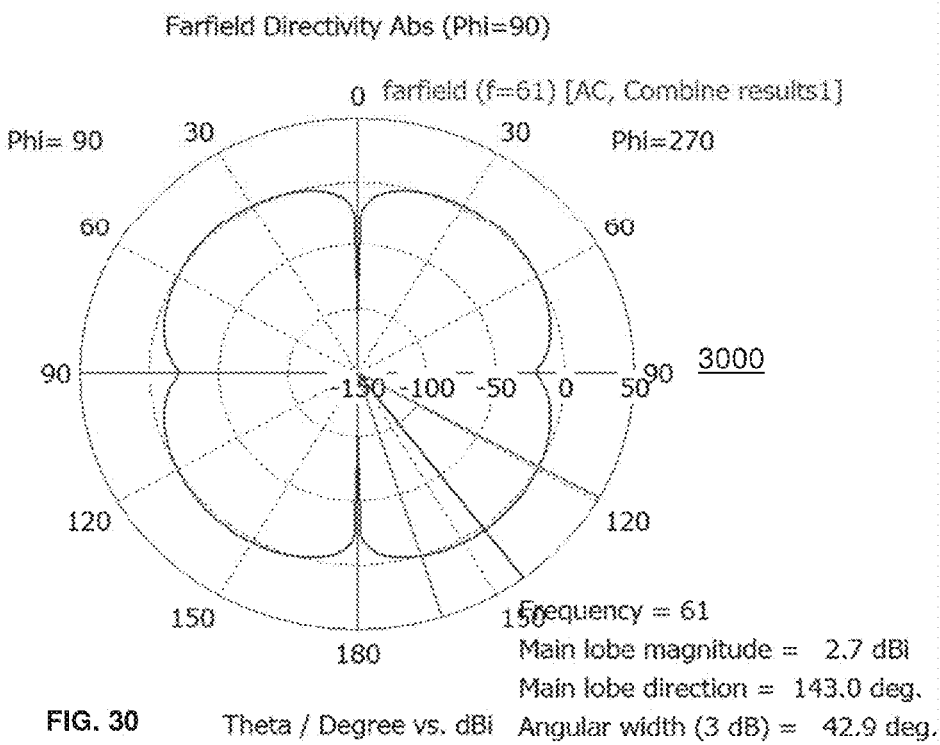
FIG. 30 shows a two dimensional directivity radiation pattern for the antenna of FIG. 27.

Referring to FIG. 27 there is shown a two feed half wave dipole according to an embodiment of the present matter. The two feed point dipole 2700 is formed by having a second feed point 2708 added to the dipole antenna 2300 of FIG. 23. The two feed points 2708, 2308 are symmetrically located on either side of the centre line 2306 of the radiating element 2302, at about 0.78 mm from the centre 2306. The reflection coefficient of the two feed point dipole antenna operated at the second harmonic of the fundamental is shown in FIG. 28. Also, FIG. 29 shows a three dimensional far field directivity radiation pattern for the antenna 2700 and FIG. 30 shows the corresponding two dimensional directivity radiation pattern. In this instance both feeds are operated simultaneously and out of phase by 180 degrees.

Figure 31:
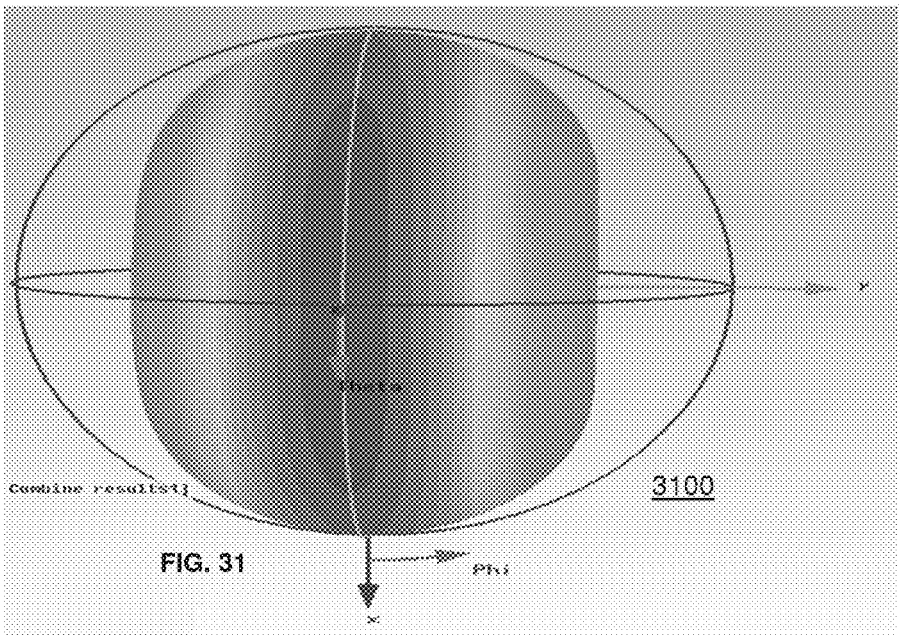
FIG. 31 shows a three dimensional (3D) directivity radiation pattern for in-phase feeds for the antenna of FIG. 27.
Figure 32:
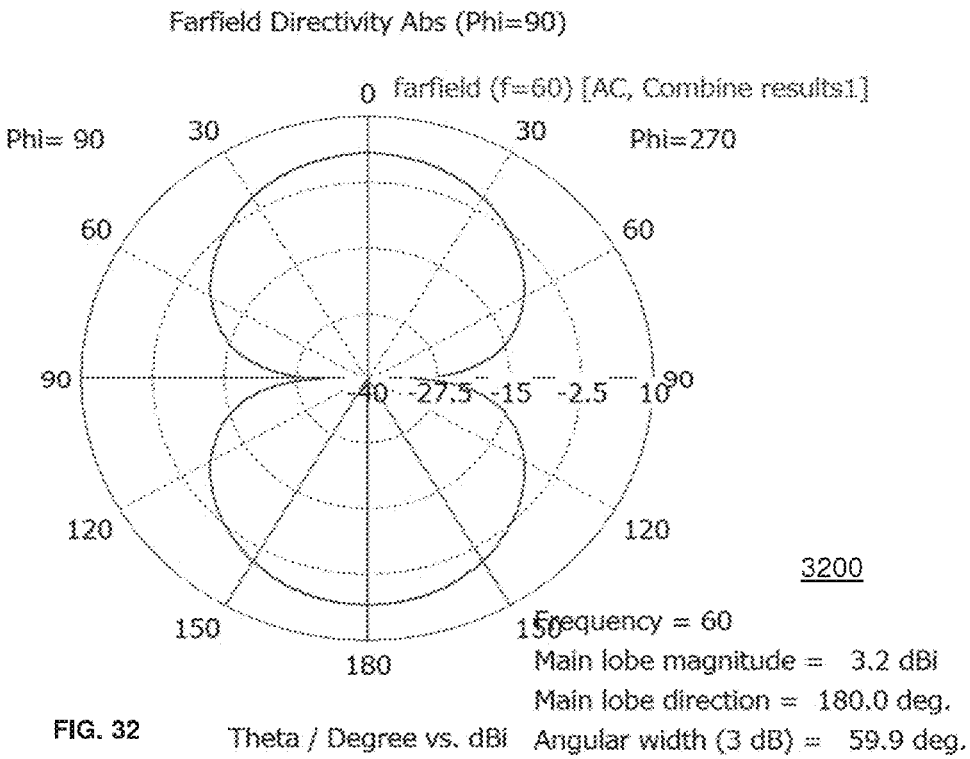
FIG. 32 show a 2D directivity radiation pattern for the antenna of FIG. 30.

When the phase between the feed at feed point 1 (port 1) and feed point 2(port 2) is 0 degrees, the 3D directivity radiation pattern is shown in FIG. 31 and the corresponding 2D directivity radiation pattern is shown in FIG. 32. The maximum directivity achieved is 3.2 dBi at a main lobe direction of 180 degrees which is higher than the maximum directivity achieved with traditional dipole with single feed that is placed at the center. The achieved realized gain is 3.21 dBi.

Figure 33:
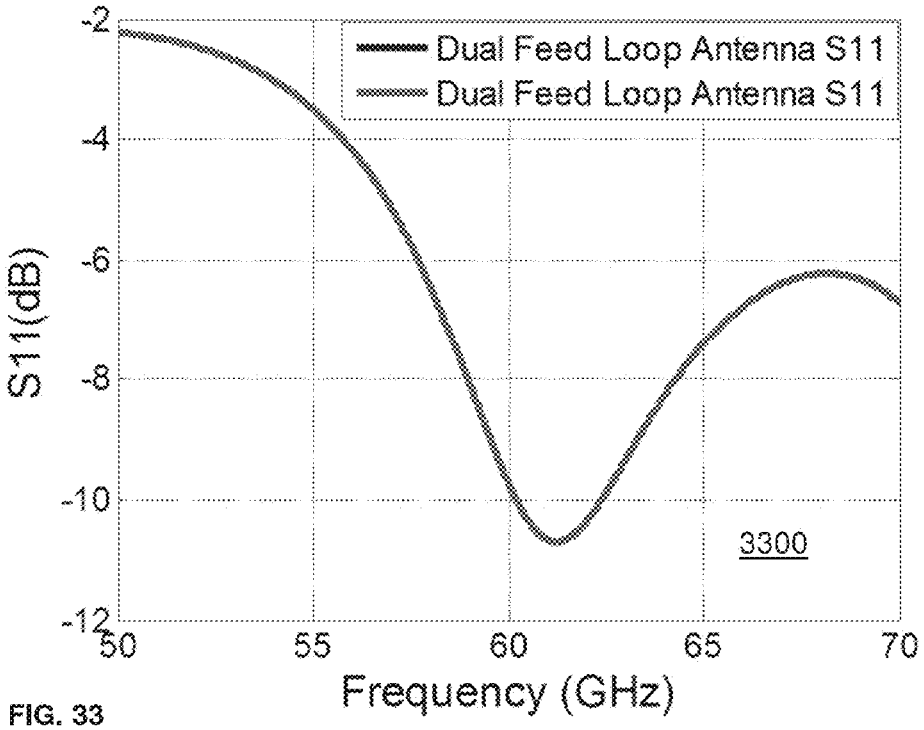
FIG. 33 shows a reflection coefficient for an antenna operated at a fourth harmonic according to an embodiment of the present matter.
Figure 34:
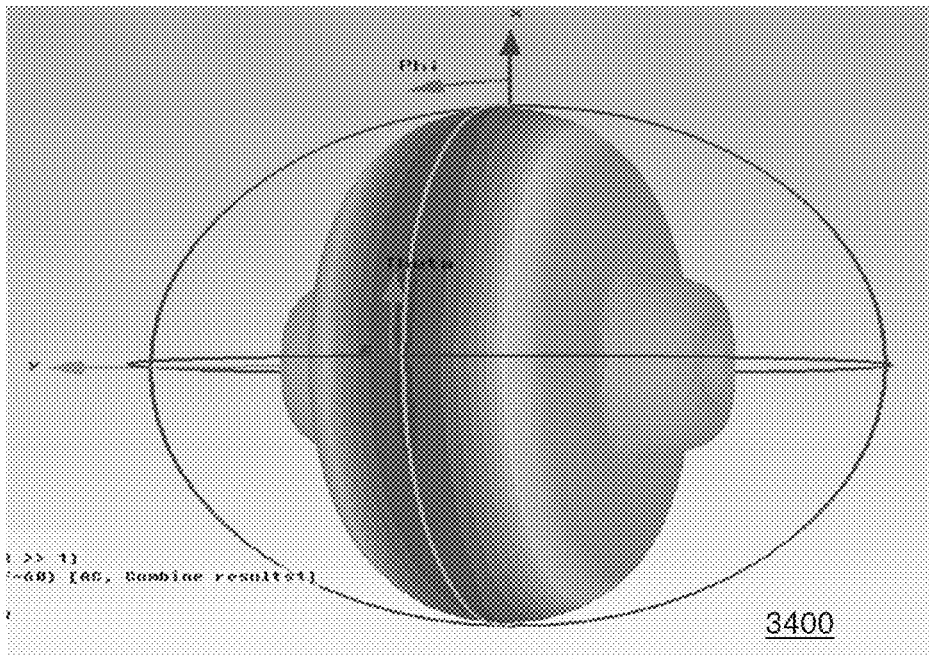
FIG. 34 shows a three dimensional (3D) directivity radiation pattern for the antenna of FIG. 33.
Figure 35:
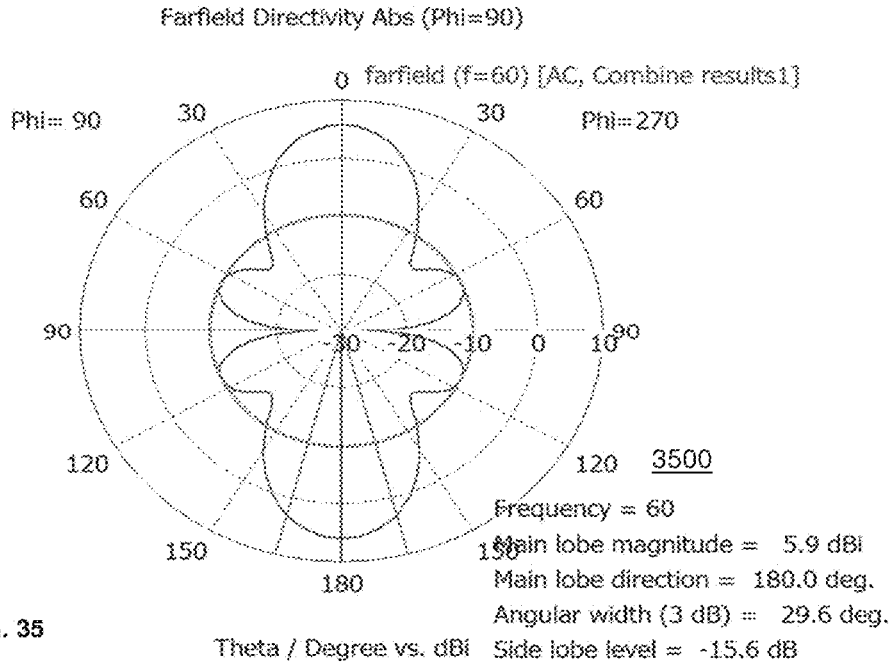
FIG. 35 shows a two dimensional (2D) directivity radiation pattern for the antenna of FIG. 33.

To further increase the directivity of the two feed dipole antenna 2700, the two feed dipole antenna may be redesigned to operate at the fourth harmonics. In other words the antenna is constructed with dimensions at a fundamental resonance of 15 GHz and only two feeds are connected at feed points on either side of the centre of the radiating element. The reflection coefficient is shown in FIG. 33. Also, the 3D and 2D directivity patterns are shown in FIGS. 34 and 35, respectively. The directivity of the two feed dipole antenna is increased and the achieved value is 5.9 dBi while the realized gain is 5.76 dBi.

As may be appreciated from the above discussion of the loop antenna and half wave dipole antenna, a relationship exists between the position of the feed point and the harmonic that it can excite on the antenna; for example the position of the feed point on the dipole where the current distribution for the $k^{th}$ harmonic is at a maximum also happens to be the location where the input impedance is at a minimum for that harmonic. This results in a simple design rule. To generate other higher harmonics than illustrated herein the feed points may be placed in other positions. Of course if the fourth harmonic is used, for example, there are four feed points however depending on the performance improvement required different numbers of feeds may be used ranging from one to four (for a $4^{th}$ harmonic antenna). This may be generalized to n harmonics. In general depending on the antenna type, the specific antenna type may support even harmonics, odd harmonics or both. Other antenna types to which the present principles may be applied include, but not limited to, patch antennas, PIFA's (patch inverted F-antenna), monopoles, dipoles to name a few.

Figure 36:
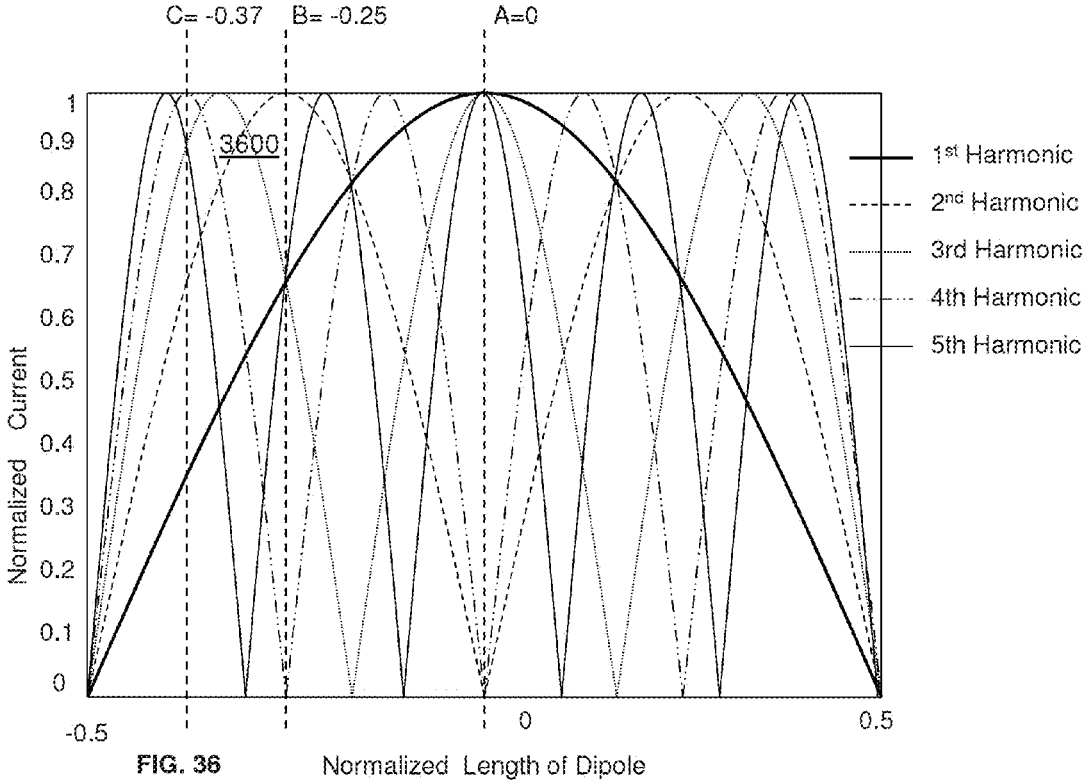
FIG. 36 shows a graph of a normalized current distribution versus normalized length for a centre fed single feed half wave dipole antenna.

This may be better understood by referring to FIG. 36 where there is shown a graph 3600 of a normalized current distribution versus normalized length for a single feed half wave dipole. The current generally has a sinusoidal distribution at the various harmonics. A half wave dipole antenna fed from the center will only support odd harmonic (e.g. first, third, fifth harmonic) frequencies as may be seen from the sinusoidal current distribution 3600. In other words in a conventional half wave dipole, for the even harmonics the current is at a minimum (zero) at the feed point which means that the input impedance (V/I) is infinite i.e. no power is transferred to the antenna.

From the graph 3600 it may be seen that at the first harmonic the current has a half wave sinusoidal distribution with a maxima at the centre (along the line A=0). In order to implement an antenna operable at a first harmonic (e.g. 60 Ghz) according to an embodiment of the present matter a feed is located at a location B=−0.25 (or the symmetrically opposite location at +0.25). The locations thus correspond to where the second harmonic current distribution shows maxima. In this feed arrangement the antenna is designed (dimensioned) for operation at 60 GHz and also operated at 60 GHz.

Similarly, a dual feed arrangement operable at the first harmonic maybe implemented by locating the respective feeds at B=−0.25 and the symmetrically opposite location at +0.25.

If the antenna is designed (dimensioned) for 30 GHz and operated at the second harmonic (60 GHz) greater performance improvement is achieved with the feeds similarly located (at the second harmonic current maxima) as described above.

As may be seen the antenna may be designed to operate at high harmonics, however the dimensions of the antenna will be correspondingly larger since the fundamental is at a lower frequency. For example if it is desired to operate an antenna at its third harmonic (60 GHz), the antenna would be dimensioned to correspond to a fundamental resonance at 20 GHz, which is significantly larger than a 60 GHz antenna. Furthermore the number of feeds would also be increased to three (corresponding to three current maxima) in order to obtain the maximum performance.

The above described antennae may be implemented in any UE. One exemplary device is described below with regard to FIG. 37.

UE 3700 is typically a two-way wireless communication device having voice and data communication capabilities. Depending on the exact functionality provided, the UE may be referred to as a data messaging device, a two-way pager, a wireless e-mail device, a cellular telephone with data messaging capabilities, a wireless Internet appliance, a wireless device, a mobile device, or a data communication device, as examples.

Where UE 3700 is enabled for two-way communication, it may incorporate a communication subsystem 3711, including a receiver 3712 and a transmitter 3714, as well as associated components such as one or more antenna elements 3716 and 3718, local oscillators (LOs) 3713, and a processing module such as a digital signal processor (DSP) 3720. As will be apparent to those skilled in the field of communications, the particular design of the communication subsystem 3711 will be dependent upon the communication network in which the device is intended to operate. The radio frequency front end of communication subsystem 3711 can be any of the embodiments described above.

Network access requirements will also vary depending upon the type of network 3719. In some networks network access is associated with a subscriber or user of UE 3700. A UE may require a removable user identity module (RUIM) or a subscriber identity module (SIM) card in order to operate on a network. The SIM/RUIM interface 3744 is normally similar to a card-slot into which a SIM/RUIM card can be inserted and ejected. The SIM/RUIM card can have memory and hold many key configurations 3751, and other information 3753 such as identification, and subscriber related information.

Figure 37:
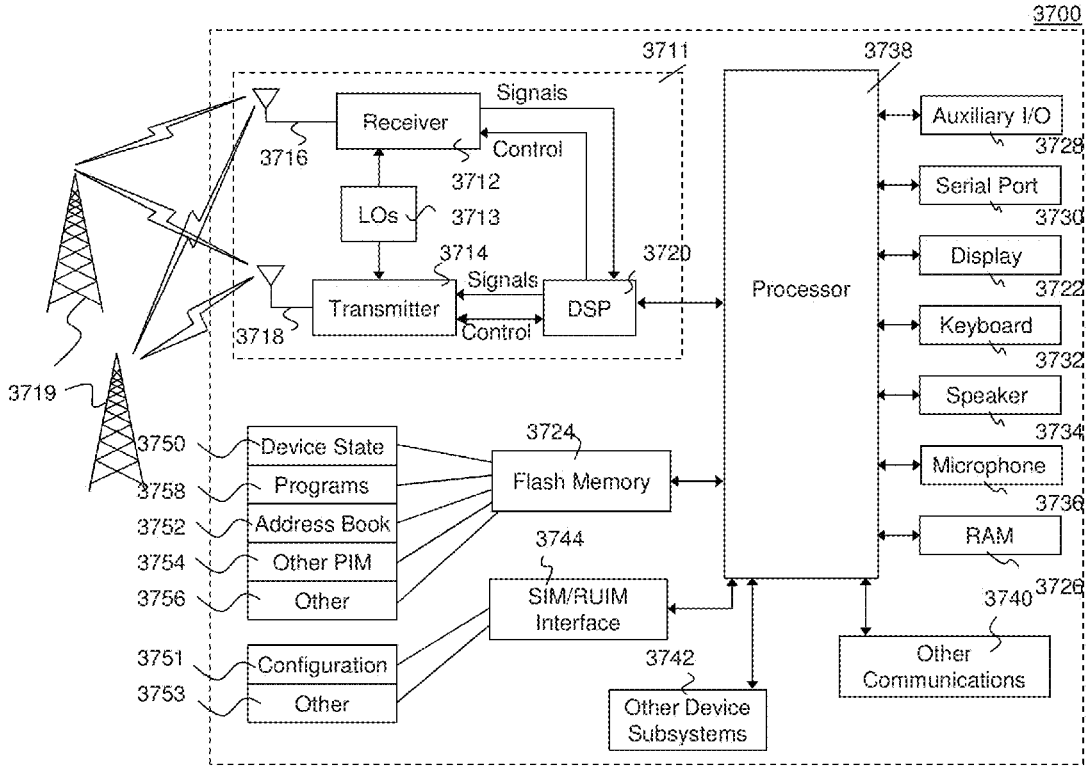
FIG. 37 is a schematic diagram of a two-way wireless communication device for which the antenna according to embodiments of the present matter may be used.

When required network registration or activation procedures have been completed, UE 3700 may send and receive communication signals over the network 3719. As illustrated in FIG. 37, network 3719 can consist of multiple base stations communicating with the UE.

Signals received by antenna 3716 through communication network 3719 are input to receiver 3712, which may perform such common receiver functions as signal amplification, frequency down conversion, filtering, channel selection and the like. A/D conversion of a received signal allows more complex communication functions such as demodulation and decoding to be performed in the DSP 3720. In a similar manner, signals to be transmitted are processed, including modulation and encoding for example, by DSP 3720 and input to transmitter 3714 for digital to analog conversion, frequency up conversion, filtering, amplification and transmission over the communication network 3719 via antenna 3718. DSP 3720 not only processes communication signals, but also provides for receiver and transmitter control. For example, the gains applied to communication signals in receiver 3712 and transmitter 3714 may be adaptively controlled through automatic gain control algorithms implemented in DSP 3720.

UE 3700 generally includes a processor 3738 which controls the overall operation of the device. Communication functions, including data and voice communications, are performed through communication subsystem 3711. Processor 3738 also interacts with further device subsystems such as the display 3722, flash memory 3724, random access memory (RAM) 3726, auxiliary input/output (I/O) subsystems 3728, serial port 3730, one or more keyboards or keypads 3732, speaker 3734, microphone 3736, other communication subsystem 3740 such as a short-range communications subsystem and any other device subsystems generally designated as 3742. Serial port 3730 could include a USB port or other port known to those in the art.

Some of the subsystems shown in FIG. 37 perform communication-related functions, whereas other subsystems may provide "resident" or on-device functions. Notably, some subsystems, such as keyboard 3732 and display 3722, for example, may be used for both communication-related functions, such as entering a text message for transmission over a communication network, and device-resident functions such as a calculator or task list.

Operating system software used by the processor 3738 may be stored in a persistent store such as flash memory 3724, which may instead be a read-only memory (ROM) or similar storage element (not shown). Those skilled in the art will appreciate that the operating system, specific device applications, or parts thereof, may be temporarily loaded into a volatile memory such as RAM 3726. Received communication signals may also be stored in RAM 3726.

As shown, flash memory 3724 can be segregated into different areas for both computer programs 3758 and program data storage 3750, 3752, 3754 and 3756. These different storage types indicate that each program can allocate a portion of flash memory 3724 for their own data storage requirements. Processor 3738, in addition to its operating system functions, may enable execution of software applications on the UE. A predetermined set of applications that control basic operations, including at least data and voice communication applications for example, will normally be installed on UE 3700 during manufacturing. Other applications could be installed subsequently or dynamically.

Applications and software may be stored on any computer readable storage medium. The computer readable storage medium may be a tangible or in transitory/non-transitory medium such as optical (e.g., CD, DVD, etc.), magnetic (e.g., tape) or other memory known in the art.

One software application may be a personal information manager (PIM) application having the ability to organize and manage data items relating to the user of the UE such as, but not limited to, e-mail, calendar events, voice mails, appointments, and task items. Naturally, one or more memory stores would be available on the UE to facilitate storage of PIM data items. Such PIM application may have the ability to send and receive data items, via the wireless network 3719. Further applications may also be loaded onto the UE 3700 through the network 3719, an auxiliary I/O subsystem 3728, serial port 3730, short-range communications subsystem 3740 or any other suitable subsystem 3742, and installed by a user in the RAM 3726 or a non-volatile store (not shown) for execution by the processor 3738. Such flexibility in application installation increases the functionality of the device and may provide enhanced on-device functions, communication-related functions, or both. For example, secure communication applications may enable electronic commerce functions and other such financial transactions to be performed using the UE 3700.

In a data communication mode, a received signal such as a text message or web page download will be processed by the communication subsystem 3711 and input to the processor 3738, which may further process the received signal for output to the display 3722, or alternatively to an auxiliary I/O device 3728.

A user of UE 3700 may also compose data items such as email messages for example, using the keyboard 3732, which may be a complete alphanumeric keyboard or telephone-type keypad, among others, in conjunction with the display 3722 and possibly an auxiliary I/O device 3728. Such composed items may then be transmitted over a communication network through the communication subsystem 3711.

For voice communications, overall operation of UE 3700 is similar, except that received signals would typically be output to a speaker 3734 and signals for transmission would be generated by a microphone 3736. Alternative voice or audio I/O subsystems, such as a voice message recording subsystem, may also be implemented on UE 3700. Although voice or audio signal output is generally accomplished primarily through the speaker 3734, display 3722 may also be used to provide an indication of the identity of a calling party, the duration of a voice call, or other voice call related information for example.

Serial port 3730 in FIG. 37 would normally be implemented in a personal digital assistant (PDA)-type UE for which synchronization with a user's desktop computer (not shown) may be desirable, but is an optional device component. Such a port 3730 would enable a user to set preferences through an external device or software application and would extend the capabilities of UE 3700 by providing for information or software downloads to UE 3700 other than through a wireless communication network. The alternate download path may for example be used to load an encryption key onto the device through a direct and thus reliable and trusted connection to thereby enable secure device communication. As will be appreciated by those skilled in the art, serial port 3730 can further be used to connect the UE to a computer to act as a modem.

Other communications subsystems 3740, such as a short-range communications subsystem, is a further optional component which may provide for communication between UE 3700 and different systems or devices, which need not necessarily be similar devices. For example, the subsystem 3740 may include an infrared device and associated circuits and components or a Bluetooth™ communication module to provide for communication with similarly enabled systems and devices. Subsystem 3740 may further include non-cellular communications such as WiFi or WiMAX.

Figure 38:
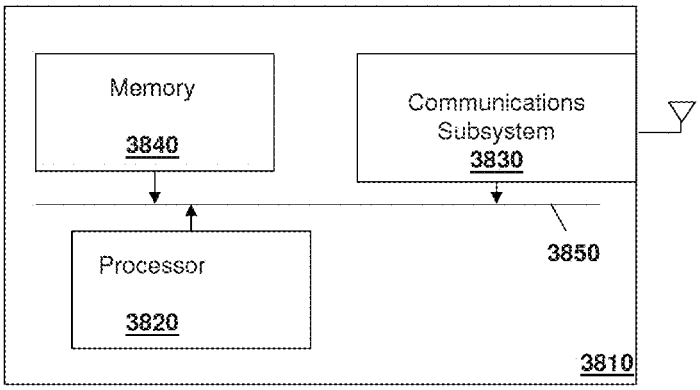
FIG. 38 shows a schematic diagram of a network element for which the antenna according to embodiments of the present matter may be used.

The above may be implemented by any network element. A simplified network element is shown with regard to FIG. 38. The network element of FIG. 38 shows an architecture which may, for example, be used for the base stations or eNBs. In FIG. 38, network element 3810 includes a processor 3820 and a communications subsystem 3830, where the processor 3820 and communications subsystem 3830 cooperate to perform the methods of the embodiments described above.

The embodiments described herein are examples of structures, systems or methods having elements corresponding to elements of the techniques of this application. This written description may enable those skilled in the art to make and use embodiments having alternative elements that likewise correspond to the elements of the techniques of this application. The intended scope of the techniques of this application thus includes other structures, systems or methods that do not differ from the techniques of this application as described herein, and further includes other structures, systems or methods with insubstantial differences from the techniques of this application as described herein.

For example aspects of the present matter may be described by the following statements:

a. an antenna, comprising a radiating element configured to have a fundamental resonance frequency being regarded as a first harmonic resonance frequency $f_o$; and feed points positioned on the configured radiating element at locations that correspond to, current maxima of a harmonic frequency, the harmonic frequency being a multiple of the first harmonic resonance frequency, the antenna feed points being operable at an operating frequency to constructively combine their respective antenna radiation patterns.

b. The antenna of in statement a, wherein one of or both the locations and the feedpoints correspond in number to the multiple of the first harmonic resonance frequency.

c. The antenna in any one of the preceding statements, wherein the operating frequency, is selected from one of the fundamental resonance frequency and the harmonic frequency.

d. The antenna in any one of the preceding statements, wherein operation of the feed points are alternated in time at the operating frequency.

e. The antenna in any one of the preceding statements, wherein one or more feeds applied to respective feed points are different in phase to others of feeds applied to corresponding others of feed points to steer the antenna beam pattern.

f. The antenna in any one of the preceding statements, wherein the radiating element is a loop.

g. The antenna in any one of the preceding statements, wherein the radiating element is a dipole.

h. The antenna in any one of the preceding statements, wherein the feed points are located on either side of a midpoint of the radiating element.

i. The antenna in any one of the preceding statements, further including a reflector element spaced from the radiating element.

j. The antenna in any one of the preceding statements, further including a ground conductor spaced from the radiating element.

k. The antenna in any one of the preceding statements, including a dielectric substrate having opposing surfaces, wherein the radiating element is formed on one surface and a ground conductor is formed on the opposing surface.

l. An antenna for transmitting and receiving radiation, comprising a radiating element configured to have a basic resonance frequency being regarded as a first harmonic resonance frequency $f_o$; and feed points positioned at locations on the configured radiating element, the locations selected to induce constructive combining of respective antenna radiation from the feed points when simultaneously fed at an operating frequency of the antenna.

m. A method for constructing an antenna comprising configuring a radiating element to have a basic resonance frequency being regarded as a first harmonic resonance frequency $f_o$; determining locations of feed points on the configured radiating element where multiples of the first harmonic resonance frequency have current maxima; and connecting feeds to a number of the determined locations of feed points.

n. The method in any one of the preceding statements, including operating the antenna at a multiple of the first harmonic resonance frequency.

o. The method in any one of the preceding statements, further including determining a desired direction of a radiation pattern of the antenna and configuring a phase between two or more of the feed points to direct the radiation pattern in the desired direction.

p. The method in any one of the preceding statements, the configuring a phase including configuring a phase tuning element.

The invention claimed is:

1. An antenna, comprising:

a plurality of feed points;

a radiating element configured to have a fundamental resonance frequency being regarded as a first harmonic resonance frequency fo when excited at one of the plurality of feed points; and the plurality of feed points positioned on the configured radiating element each for exciting a different harmonic of the fundamental resonance frequency and, each positioned at respective locations that correspond to maxima of distribution for a respective harmonic of the fundamental resonance frequency, the feed points being operable at an operating frequency of the antenna that constructively combines their respective antenna radiation patterns.

2. The antenna of claim 1, wherein the locations correspond in number to the different harmonics.

3. The antenna of claim 1, wherein the feed points correspond in number to the different harmonics.

4. The antenna of claim 1, wherein the operating frequency, corresponds to the fundamental resonance frequency.

5. The antenna of claim 1, wherein the operating frequency corresponds to one of the different harmonic frequencies.

6. The antenna of claim 1, wherein operation of the feed points are alternated in time at the operating frequency.

7. The antenna of claim 1 wherein at least one of the feed points is connected to a transmitter and at least one other feed point is connected to a receiver, wherein operation of the connected feed points are alternated in time with the transmitter and the receiver operating at a same frequency being the operating frequency of the antenna.

8. The antenna of claim 1, wherein the one of the plurality of feed points has a feed of a different polarity than the other of the plurality of feed points.

9. The antenna of claim 1, wherein one or more feeds applied to respective feed points are different in phase to others of feeds applied to corresponding others of feed points to steer the antenna beam pattern.

10. The antenna of claim 1, wherein the radiating element is a loop.

11. The antenna of claim 1, wherein the radiating element is a dipole.

12. The antenna of claim 11, wherein the feed points are located on either side of a midpoint of said dipole.

13. The antenna of claim 1, further including a reflector element spaced from the radiating element.

14. The antenna of claim 1, further including a ground conductor spaced from the radiating element.

15. The antenna of claim 1, including a dielectric substrate having opposing surfaces, wherein the radiating element is formed on one surface and a ground conductor is formed on the opposing surface.

16. An antenna for transmitting and receiving radiation, comprising:

a plurality of feed points;

a radiating element configured to have a fundamental resonance frequency being regarded as a first harmonic resonance frequency fo when excited at one of the plurality of feed points; and the plurality of feed points positioned at respective locations on said configured radiating element, each for exciting a different harmonic of the fundamental resonance frequency and the respective locations selected to induce constructive combining of respective antenna radiation from the feed points when simultaneously fed at an operating frequency of the antenna.

17. A method for constructing an antenna comprising:

configuring a radiating element to have a basic resonance frequency being regarded as a first harmonic resonance frequency fo when excited at a fundamental resonance frequency;

determining respective locations of a plurality of feed points on said configured radiating element where multiples of said first harmonic resonance frequency that correspond to maxima of a current distribution for respective harmonics of the fundamental resonance frequency; and the respective locations that correspond to maxima of current distribution for a respective harmonic of the fundamental resonance frequency; and connecting feeds to a number of said determined locations of feed points.

18. The method according to claim 17, including operating said antenna at a multiple of said first harmonic resonance frequency.

19. The method according to claim 17, further including determining a desired direction of a radiation pattern of said antenna and configuring a phase between two or more of said feed points to direct said radiation pattern in said desired direction.

20. The method according to claim 19, said configuring a phase including configuring a phase tuning element.

* * * * *